US011700984B2

(12) United States Patent
Conrad

(10) Patent No.: US 11,700,984 B2
(45) Date of Patent: Jul. 18, 2023

(54) CONFIGURATION OF A SURFACE CLEANING APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton (CA)

( * ) Notice: Subject to any disclaimer, the term of this patent is extended or adjusted under 35 U.S.C. 154(b) by 511 days.

(21) Appl. No.: 16/864,910

(22) Filed: May 1, 2020

(65) Prior Publication Data

US 2020/0253435 A1 Aug. 13, 2020

Related U.S. Application Data

(63) Continuation of application No. 14/475,219, filed on Sep. 2, 2014, now Pat. No. 10,765,277, which is a (Continued)

(30) Foreign Application Priority Data

Aug. 29, 2007 (CA) ..... CA 2599303
Mar. 11, 2009 (CA) ..... CA 2658005

(51) Int. Cl.
*A47L 5/22* (2006.01)
*A47L 5/36* (2006.01)
(Continued)

(52) U.S. Cl.
CPC ..... *A47L 5/225* (2013.01); *A47L 5/24* (2013.01); *A47L 5/36* (2013.01); *A47L 9/1666* (2013.01);
(Continued)

(58) Field of Classification Search
CPC ... A47L 5/225; A47L 5/34; A47L 5/36; A47L 9/327
See application file for complete search history.

(56) References Cited

U.S. PATENT DOCUMENTS 2,036,694 A 4/1936 Hansson
2,071,975 A 2/1937 Ruscoe
(Continued)

FOREIGN PATENT DOCUMENTS

CA 1218962 A1 3/1987
CA 2241644 12/2007
(Continued)

OTHER PUBLICATIONS

English machine translation of CN1626025A, published on Oct. 15, 2005.

(Continued)

*Primary Examiner* — Bryan R Muller
(74) *Attorney, Agent, or Firm* — Philip C. Mendes da Costa; Bereskin & Parr LLP/S.E.N.C.R.L., s.r.l.

(57) ABSTRACT

A surface cleaning apparatus has a surface cleaning head having a pivoting connector, an upper end of the pivoting connector providing an air outlet of the surface cleaning head. A support consisting of an upflow duct is pivotally mounted to the surface cleaning head by the pivoting connector. A surface cleaning unit is vertically removably mounted to an upper end of the support. The surface cleaning unit comprises a cyclone unit, a pre-motor filter, a suction motor and flexible hose.

5 Claims, 14 Drawing Sheets

Related U.S. Application Data continuation-in-part of application No. 14/036,818, filed on Sep. 25, 2013, now Pat. No. 9,301,662, which is a continuation of application No. 13/396,918, filed on Feb. 15, 2012, now Pat. No. 8,567,006, said application No. 14/475,219 is a continuation-in-part of application No. 12/721,128, filed on Mar. 10, 2010, now Pat. No. 8,950,039, which is a continuation-in-part of application No. 12/675,512, filed on Feb. 26, 2010, now abandoned, and a continuation-in-part of application No. 12/675,540, filed on Feb. 26, 2010, now Pat. No. 9,027,201, and a continuation-in-part of application No. 12/675,636, filed as application No. PCT/CA2008/001530, filed as application No. PCT/CA2008/001531, filed as application No. PCT/CA2008/001519, said application No. 13/396,918 is a continuation of application No. 11/954,310, filed on Dec. 12, 2007, now Pat. No. 8,166,607.

(60) Provisional application No. 60/869,586, filed on Dec. 12, 2006.

(51) Int. Cl.

| | |
|---|---|
| ***A47L 9/32*** | (2006.01) |
| ***A47L 5/24*** | (2006.01) |
| ***A47L 9/16*** | (2006.01) |
| *A47L 5/28* | (2006.01) |

(52) U.S. Cl.

CPC ..... *A47L 9/327* (2013.01); *A47L 5/28* (2013.01); *A47L 9/1625* (2013.01)

(56) References Cited

U.S. PATENT DOCUMENTS

| | | | |
|---|---|---|---|
| 2,533,057 | A | 12/1950 | Senne |
| 2,542,634 | A | 2/1951 | Davis et al. |
| 2,559,384 | A | 4/1951 | Senne |
| 2,621,756 | A | 12/1952 | Senne |
| 2,632,524 | A | 3/1953 | Senne |
| 2,913,111 | A | 11/1959 | Rogers |
| 2,942,691 | A | 6/1960 | Dillon |
| 3,015,122 | A | 1/1962 | Cook |
| 3,130,157 | A | 4/1964 | Kelsall et al. |
| 3,200,568 | A | 8/1965 | McNeil |
| 3,310,828 | A | 3/1967 | Clark |
| 3,320,727 | A | 5/1967 | Farley et al. |
| 3,356,334 | A | 12/1967 | Domer |
| 3,457,744 | A | 7/1969 | Bisbing |
| 3,530,649 | A | 9/1970 | Porsch et al. |
| 3,582,616 | A | 6/1971 | Wrob |
| 3,822,533 | A | 7/1974 | Oranje |
| 3,898,068 | A | 8/1975 | McNeil et al. |
| 3,988,132 | A | 10/1976 | Oranje |
| 3,988,133 | A | 10/1976 | Schady |
| 4,187,088 | A | 2/1980 | Hodgson |
| 4,236,903 | A | 12/1980 | Malmsten |
| 4,373,228 | A | 2/1983 | Dyson |
| 4,393,536 | A | 7/1983 | Tapp |
| 4,443,910 | A | 4/1984 | Fitzwater |
| 4,573,236 | A | 3/1986 | Dyson |
| 4,635,315 | A | 1/1987 | Kozak |
| 4,636,230 | A | 1/1987 | Fan |
| 4,826,515 | A | 5/1989 | Dyson |
| 4,831,685 | A | 5/1989 | Bosyj et al. |
| 4,836,515 | A | 5/1989 | Dyson |
| 4,905,342 | A | 3/1990 | Ataka |
| 5,054,157 | A | 10/1991 | Werner et al. |
| 5,078,761 | A | 1/1992 | Dyson |
| 5,129,125 | A | 7/1992 | Gamou et al. |
| 5,230,722 | A | 7/1993 | Yonkers |
| 5,267,371 | A | 12/1993 | Soler et al. |
| 5,287,591 | A | 2/1994 | Rench et al. |
| 5,309,600 | A | 5/1994 | Weaver et al. |
| 5,309,601 | A | 5/1994 | Hampton et al. |
| 5,524,321 | A | 6/1996 | Weaver et al. |
| 5,715,566 | A | 2/1998 | Weaver et al. |
| 5,836,047 | A | 11/1998 | Lee et al. |
| 5,842,254 | A | 12/1998 | Lee |
| 5,858,038 | A | 1/1999 | Dyson et al. |
| 5,966,774 | A | 10/1999 | Bone et al. |
| 6,058,559 | A | 5/2000 | Yoshimi et al. |
| 6,070,291 | A | 6/2000 | Bair et al. |
| 6,081,961 | A | 7/2000 | Wang |
| 6,146,434 | A | 11/2000 | Scalfani et al. |
| 6,210,469 | B1 | 4/2001 | Tokar |
| 6,221,134 | B1 | 4/2001 | Conrad et al. |
| 6,228,260 | B1 | 5/2001 | Conrad et al. |
| 6,231,645 | B1 | 5/2001 | Conrad et al. |
| 6,231,649 | B1 | 5/2001 | Dyson et al. |
| 6,251,296 | B1 | 6/2001 | Conrad et al. |
| 6,256,832 | B1 | 7/2001 | Dyson |
| 6,295,692 | B1 | 10/2001 | Shideler |
| 6,406,505 | B1 | 6/2002 | Oh et al. |
| 6,434,785 | B1 | 8/2002 | Vandenbelt et al. |
| 6,440,197 | B1 | 8/2002 | Conrad et al. |
| 6,463,622 | B2 | 10/2002 | Wright et al. |
| 6,531,066 | B1 | 3/2003 | Saunders et al. |
| 6,553,612 | B1 | 4/2003 | Dyson et al. |
| 6,560,818 | B1 | 5/2003 | Hasko |
| 6,581,239 | B1 | 6/2003 | Dyson et al. |
| 6,599,338 | B2 | 7/2003 | Oh et al. |
| 6,623,539 | B2 | 9/2003 | Lee et al. |
| 6,736,873 | B2 | 5/2004 | Conrad et al. |
| 6,746,500 | B1 | 6/2004 | Park et al. |
| 6,779,227 | B2 | 8/2004 | Lee |
| 6,782,583 | B2 | 8/2004 | Oh |
| 6,782,585 | B1 | 8/2004 | Conrad et al. |
| 6,833,015 | B2 | 12/2004 | Oh et al. |
| 6,848,146 | B2 | 2/2005 | Wright et al. |
| 6,874,197 | B1 | 4/2005 | Conrad |
| 6,902,596 | B2 | 6/2005 | Conrad et al. |
| 7,131,165 | B2 | 11/2006 | Wright et al. |
| 7,146,681 | B2 | 12/2006 | Wright et al. |
| 7,160,346 | B2 | 1/2007 | Park |
| 7,188,388 | B2 | 3/2007 | Best et al. |
| 7,222,393 | B2 | 5/2007 | Kaffenberger et al. |
| 7,247,181 | B2 | 7/2007 | Hansen |
| 7,278,181 | B2 | 10/2007 | Harris et al. |
| 7,335,242 | B2 | 2/2008 | Oh |
| 7,370,387 | B2 | 5/2008 | Walker et al. |
| 7,377,008 | B2 | 5/2008 | Park et al. |
| 7,381,234 | B2 | 6/2008 | Oh |
| 7,386,916 | B2 | 6/2008 | Bone |
| 7,448,363 | B1 | 11/2008 | Rasmussen et al. |
| 7,485,164 | B2 | 2/2009 | Jeong et al. |
| 7,488,362 | B2 | 2/2009 | Jeong et al. |
| 7,540,894 | B2 | 6/2009 | Ni |
| 7,547,338 | B2 | 6/2009 | Kim et al. |
| 7,581,286 | B2 | 9/2009 | Choi |
| 7,584,522 | B1 | 9/2009 | Weeter |
| 7,594,296 | B2 | 9/2009 | Park |
| 7,597,730 | B2 | 10/2009 | Yoo et al. |
| 7,604,675 | B2 | 10/2009 | Makarov et al. |
| 7,624,475 | B2 | 12/2009 | Choi |
| 7,645,311 | B2 | 1/2010 | Oh et al. |
| 7,686,858 | B2 | 3/2010 | Oh |
| 7,794,515 | B2 | 9/2010 | Oh et al. |
| 7,882,592 | B2 | 2/2011 | Hwang et al. |
| 7,887,612 | B2 | 2/2011 | Conrad |
| 7,922,794 | B2 | 4/2011 | Morphey |
| 7,979,953 | B2 | 7/2011 | Yoo |
| 8,032,981 | B2 | 10/2011 | Yoo |
| 8,032,983 | B2 | 10/2011 | Griffith et al. |
| 8,100,999 | B2 | 1/2012 | Ashbee et al. |
| 8,127,398 | B2 | 3/2012 | Conrad |
| 8,166,607 | B2 | 5/2012 | Conrad |
| 8,191,203 | B2 | 6/2012 | Yoo |
| 8,347,455 | B2 | 1/2013 | Dyson et al. |
| 8,359,705 | B2 | 1/2013 | Conrad |
| 8,444,731 | B2 | 5/2013 | Gomiciaga-Pereda et al. |

(56) References Cited

U.S. PATENT DOCUMENTS

| | | | |
|---|---|---|---|
| 8,468,646 | B2 | 6/2013 | Yoo |
| 8,484,799 | B2 | 7/2013 | Conrad |
| 8,528,160 | B2 | 9/2013 | Conrad |
| 8,769,767 | B2 | 7/2014 | Conrad |
| 2002/0011053 | A1 | 1/2002 | Oh |
| 2002/0062531 | A1 | 5/2002 | Oh |
| 2002/0112315 | A1 | 8/2002 | Conrad |
| 2002/0134059 | A1 | 9/2002 | Oh |
| 2002/0162188 | A1 | 11/2002 | Harmen |
| 2002/0178535 | A1 | 12/2002 | Oh et al. |
| 2002/0178698 | A1 | 12/2002 | Oh et al. |
| 2002/0178699 | A1 | 12/2002 | Oh |
| 2003/0037403 | A1 | 2/2003 | Lang |
| 2003/0046910 | A1 | 3/2003 | Lee |
| 2003/0066273 | A1 | 4/2003 | Choi et al. |
| 2003/0158238 | A1 | 8/2003 | Hale et al. |
| 2003/0159411 | A1 | 8/2003 | Hansen et al. |
| 2004/0010885 | A1 | 1/2004 | Hitzelberger et al. |
| 2004/0025285 | A1 | 2/2004 | McCormick et al. |
| 2004/0112022 | A1 | 6/2004 | Vuijk |
| 2004/0163201 | A1 | 8/2004 | Murphy et al. |
| 2004/0194251 | A1 | 10/2004 | Overvaag et al. |
| 2004/0216263 | A1 | 11/2004 | Best |
| 2004/0216264 | A1 | 11/2004 | Shaver et al. |
| 2005/0081321 | A1 | 4/2005 | Milligan et al. |
| 2005/0125940 | A1 | 6/2005 | McDowell |
| 2005/0198769 | A1 | 9/2005 | Lee et al. |
| 2005/0252179 | A1 | 11/2005 | Oh et al. |
| 2006/0037172 | A1 | 2/2006 | Choi |
| 2006/0042038 | A1 | 3/2006 | Arnold et al. |
| 2006/0042206 | A1 | 3/2006 | Arnold et al. |
| 2006/0080947 | A1 | 4/2006 | Lee et al. |
| 2006/0090290 | A1 | 5/2006 | Lau |
| 2006/0123590 | A1 | 6/2006 | Fester et al. |
| 2006/0137304 | A1 | 6/2006 | Jeong et al. |
| 2006/0137305 | A1 | 6/2006 | Jung |
| 2006/0137306 | A1 | 6/2006 | Jeong et al. |
| 2006/0137309 | A1 | 6/2006 | Jeong et al. |
| 2006/0137314 | A1 | 6/2006 | Conrad et al. |
| 2006/0156699 | A1 | 7/2006 | Kim |
| 2006/0162298 | A1 | 7/2006 | Oh et al. |
| 2006/0162299 | A1 | 7/2006 | North |
| 2006/0168922 | A1 | 8/2006 | Oh |
| 2006/0168923 | A1 | 8/2006 | Lee et al. |
| 2006/0207055 | A1 | 9/2006 | Ivarsson et al. |
| 2006/0207231 | A1 | 9/2006 | Arnold |
| 2006/0230715 | A1 | 10/2006 | Oh et al. |
| 2006/0230723 | A1 | 10/2006 | Kim et al. |
| 2006/0230724 | A1 | 10/2006 | Han et al. |
| 2006/0230726 | A1 | 10/2006 | Oh et al. |
| 2006/0236663 | A1 | 10/2006 | Oh |
| 2006/0278081 | A1 | 12/2006 | Han et al. |
| 2007/0012002 | A1 | 1/2007 | Oh et al. |
| 2007/0012003 | A1 | 1/2007 | Oh et al. |
| 2007/0039120 | A1 | 2/2007 | Choi |
| 2007/0067944 | A1 | 3/2007 | Kitamura |
| 2007/0079473 | A1 | 4/2007 | Min |
| 2007/0079584 | A1 | 4/2007 | Kim |
| 2007/0079585 | A1 | 4/2007 | Oh et al. |
| 2007/0079587 | A1 | 4/2007 | Kim |
| 2007/0084161 | A1 | 4/2007 | Yoo |
| 2007/0095028 | A1 | 5/2007 | Kim |
| 2007/0095029 | A1 | 5/2007 | Min |
| 2007/0095030 | A1 | 5/2007 | Oh |
| 2007/0220845 | A1 | 9/2007 | Smith |
| 2007/0226947 | A1 | 10/2007 | Kang |
| 2007/0251048 | A1 | 11/2007 | Choi |
| 2007/0271724 | A1 | 11/2007 | Hakan et al. |
| 2007/0289085 | A1 | 12/2007 | Yoo |
| 2007/0289089 | A1 | 12/2007 | Yacobi |
| 2007/0289264 | A1 | 12/2007 | Oh |
| 2008/0172821 | A1 | 1/2008 | Kang et al. |
| 2008/0040883 | A1 | 2/2008 | Beskow et al. |
| 2008/0047091 | A1 | 2/2008 | Nguyen |
| 2008/0052872 | A1 | 3/2008 | Cho |
| 2008/0083085 | A1 | 4/2008 | Genn |
| 2008/0134460 | A1 | 6/2008 | Conrad |
| 2008/0134462 | A1 | 6/2008 | Jansen et al. |
| 2008/0172995 | A1 | 7/2008 | Conrad |
| 2008/0178416 | A1 | 7/2008 | Conrad |
| 2008/0178420 | A1 | 7/2008 | Conrad |
| 2008/0184681 | A1 | 8/2008 | Oh et al. |
| 2008/0184893 | A1 | 8/2008 | Oh |
| 2008/0190080 | A1 | 8/2008 | Oh et al. |
| 2008/0196195 | A1 | 8/2008 | Conrad |
| 2008/0196196 | A1 | 8/2008 | Conrad |
| 2008/0209666 | A1 | 9/2008 | Conrad |
| 2009/0031522 | A1 | 2/2009 | Yoo |
| 2009/0044371 | A1 | 2/2009 | Yoo et al. |
| 2009/0113659 | A1 | 5/2009 | Jeon et al. |
| 2009/0144929 | A1 | 6/2009 | Yoo |
| 2009/0144932 | A1 | 6/2009 | Yoo |
| 2009/0241284 | A1 | 10/2009 | Mayes |
| 2009/0282639 | A1 | 11/2009 | Dyson et al. |
| 2009/0307864 | A1 | 12/2009 | Dyson |
| 2010/0005611 | A1 | 1/2010 | Hong et al. |
| 2010/0043170 | A1 | 2/2010 | Zugen |
| 2010/0045215 | A1 | 2/2010 | Hawker et al. |
| 2010/0071153 | A1 | 3/2010 | Genn |
| 2010/0083459 | A1 | 4/2010 | Beskow et al. |
| 2010/0095476 | A1 | 4/2010 | Kim et al. |
| 2010/0162515 | A1 | 7/2010 | Stephens |
| 2010/0175217 | A1 | 7/2010 | Conrad |
| 2010/0175219 | A1 | 7/2010 | Soen et al. |
| 2010/0229322 | A1 | 9/2010 | Conrad |
| 2010/0229336 | A1 | 9/2010 | Conrad |
| 2010/0229338 | A1 | 9/2010 | Conrad |
| 2010/0242222 | A1 | 9/2010 | Conrad |
| 2010/0293745 | A1 | 11/2010 | Coburn |
| 2011/0023262 | A1 | 2/2011 | Conrad |
| 2011/0219573 | A1 | 9/2011 | Conrad |
| 2011/0314629 | A1 | 12/2011 | Conrad |
| 2012/0000030 | A1 | 1/2012 | Conrad |
| 2012/0159734 | A1 | 6/2012 | Fujiwara |
| 2012/0222239 | A1 | 9/2012 | Conrad |
| 2012/0222245 | A1 | 9/2012 | Conrad |
| 2012/0272472 | A1 | 11/2012 | Conrad |
| 2013/0104335 | A1 | 5/2013 | Conrad |
| 2014/0237768 | A1 | 8/2014 | Conrad |
| 2016/0367094 | A1 | 12/2016 | Conrad |

FOREIGN PATENT DOCUMENTS

| | | | |
|---|---|---|---|
| CA | 2675723 | | 6/2008 |
| CA | 2658005 | | 9/2010 |
| CA | 2658014 | A1 | 9/2010 |
| CA | 2658381 | | 9/2010 |
| CA | 2658651 | | 9/2010 |
| CA | 2659212 | | 9/2010 |
| CA | 2674056 | | 9/2010 |
| CA | 2674761 | | 9/2010 |
| CA | 2678119 | | 9/2010 |
| CA | 2755305 | | 9/2010 |
| CA | 2755307 | | 9/2010 |
| CA | 2730689 | | 9/2011 |
| CA | 2574291 | C | 8/2013 |
| CA | 2677530 | | 1/2014 |
| CN | 2524655 | Y | 12/2002 |
| CN | 2534954 | Y | 2/2003 |
| CN | 1626025 | A | 10/2005 |
| CN | 1765283 | A | 5/2006 |
| CN | 1806741 | A | 7/2006 |
| CN | 1895148 | A | 1/2007 |
| CN | 100998484 | A | 7/2007 |
| CN | 101015436 | A | 8/2007 |
| CN | 101061932 | A | 10/2007 |
| CN | 101095604 | A | 1/2008 |
| CN | 201101488 | Y | 8/2008 |
| CN | 101288572 | A | 10/2008 |
| CN | 101357051 | A | 2/2009 |
| CN | 101448447 | A | 6/2009 |
| CN | 101822506 | A | 9/2010 |
| CN | 201683850 | U | 12/2010 |
| CN | 101631494 | | 4/2012 |

(56) References Cited

FOREIGN PATENT DOCUMENTS

| | | | |
|---|---|---|---|
| CN | 202699035 | | 1/2013 |
| CN | 203724037 | U | 7/2014 |
| DE | 3734355 | C2 | 6/1989 |
| DE | 10110581 | C2 | 11/2003 |
| DE | 69907201 | T2 | 2/2004 |
| DE | 60012203 | T2 | 8/2005 |
| DE | 60105004 | T2 | 8/2005 |
| DE | 60201666 | T2 | 6/2006 |
| DE | 202006017010 | U1 | 2/2007 |
| DE | 60211663 | T2 | 5/2007 |
| DE | 102007011457 | A1 | 10/2007 |
| DE | 112006003479 | T5 | 12/2008 |
| DE | 112007001314 | T5 | 4/2009 |
| DE | 112010001135 | T5 | 8/2012 |
| DE | 202012101457 | U1 | 8/2012 |
| DE | 112011104642 | T5 | 10/2013 |
| DE | 102012211246 | A1 | 1/2014 |
| EP | 0489468 | A1 | 6/1992 |
| EP | 0887040 | | 12/1998 |
| EP | 1674009 | | 6/2006 |
| EP | 1771104 | B1 | 9/2008 |
| EP | 966912 | B1 | 3/2010 |
| EP | 2049000 | B1 | 6/2011 |
| EP | 2201875 | | 4/2013 |
| EP | 1629758 | B1 | 10/2013 |
| FR | 2812531 | B1 | 11/2004 |
| GB | 2163703 | B | 1/1988 |
| GB | 2365324 | B | 7/2002 |
| GB | 2458243 | | 4/2012 |
| JP | 2000140533 | A | 5/2000 |
| JP | 2004121722 | A | 4/2004 |
| JP | 2005-40246 | | 2/2005 |
| JP | 2005040246 | A | 2/2005 |
| JP | 2005087508 | Y | 4/2005 |
| JP | 2005211350 | A | 8/2005 |
| JP | 2009261501 | A | 11/2009 |
| JP | 2010081968 | A | 4/2010 |
| JP | 2010227287 | | 10/2010 |
| KR | 1020040088978 | A | 10/2004 |
| KR | 20060112420 | A | 11/2006 |
| WO | 9619294 | A1 | 6/1996 |
| WO | 00/78546 | A1 | 12/2000 |
| WO | 2004069021 | A1 | 8/2004 |
| WO | 2005/089618 | | 2/2006 |
| WO | 2006026414 | A3 | 8/2007 |
| WO | 2007104138 | A1 | 9/2007 |
| WO | 2008/009883 | A1 | 1/2008 |
| WO | 2008/009888 | A1 | 1/2008 |
| WO | 2008/009890 | A1 | 1/2008 |
| WO | 2007084699 | A3 | 2/2008 |
| WO | 2008017802 | A1 | 2/2008 |
| WO | 2008/070980 | | 6/2008 |
| WO | 2008070966 | A1 | 6/2008 |
| WO | 2008135708 | A1 | 11/2008 |
| WO | 2009026709 | A1 | 3/2009 |
| WO | 2010102396 | A1 | 9/2010 |
| WO | 2010102410 | | 9/2010 |
| WO | 2010102411 | | 9/2010 |

OTHER PUBLICATIONS

English machine translation of CN1895148A, published on Jan. 17, 2007.
English machine translation of CN 100998484, published on Jul. 18, 2007.
English machine translation of CN101015436, published on Aug. 15, 2007.
English machine translation of CN101061932, published on Oct. 31, 2007.
English machine translation of CN 101095604, published on Jan. 2, 2008.
English machine translation of CN101288572, published on Oct. 22, 2008.
English machine translation of CN101448447, published on Jun. 3, 2009.
English machine translation of CN101822506, published on Sep. 8, 2010.
English machine translation of CN201683850, published on Dec. 29, 2010.
English machine translation of CN203724037, published on Jul. 23, 2014.
English machine translation of DE10110581, published on Nov. 13, 2003.
English machine translation of DE60012203, published on Aug. 18, 2005.
English machine translation of DE60105004, published on Aug. 16, 2005.
English machine translation of DE60201666, published on Jun. 1, 2006.
English machine translation of DE60211663, published on May 10, 2007.
English machine translation of DE69907201, published on Feb. 5, 2004.
English machine translation of DE102007011457, published on Oct. 25, 2007.
English machine translation of DE102012211246, published on Jan. 2, 2014.
English machine translation of DE112006003479, published on Dec. 18, 2008.
English machine translation of DE112007001314, published on Apr. 23, 2009.
English machine translation of DE112010001135, published on Aug. 2, 2012.
English machine translation of DE112011104642, published on Oct. 2, 2013.
English machine translation of DE202006017010, published on Feb. 8, 2007.
English machine translation of DE202012101457, published on Aug. 16, 2012.
English machine translation of JP2004121722, published on Apr. 22, 2004.
English machine translation of JP2005040246, published on Feb. 17, 2005.
English machine translation of JP2005211350, published on Aug. 11, 2005.
English machine translation of JP2009261501, published on Nov. 12, 2009.
English machine translation of JP2010081968, published on Apr. 15, 2010.
English machine translation of KR1020040088978, published on Oct. 20, 2004.
English machine translation of KR20060112420, published on Nov. 1, 2006.

CONFIGURATION OF A SURFACE CLEANING APPARATUS

CROSS REFERENCE TO RELATED APPLICATIONS

This application is a continuation of U.S. patent application Ser. No. 14/475,219, filed on Sep. 2, 2014; and (1) U.S. patent application Ser. No. 14/475,219 is a continuation-in-part of U.S. patent application Ser. No. 12/721,128, filed Mar. 10, 2010, entitled CONFIGURATION OF A SURFACE CLEANING APPARATUS, now U.S. Pat. No. 8,950,039 and claims the benefit of the filing date of Canadian Patent Application No. 2658005, filed Mar. 11, 2009, entitled CONFIGURATION OF A SURFACE CLEANING APPARATUS, which itself is (a) a continuation-in-part of U.S. patent application Ser. No. 12/675,512 filed Feb. 26, 2010 entitled CYCLONIC SURFACE CLEANING APPARATUS WITH A SPACED APART IMPINGEMENT SURFACE, which is abandoned and which was a national phase entry of PCT/CA2008/001531 which claimed priority from CA2,599,303; and is (b) a continuation-in-part of U.S. patent application Ser. No. 12/675,540 filed on Feb. 26, 2010 entitled CYCLONIC SURFACE CLEANING APPARATUS WITH EXTERNALLY POSITIONED DIRT CHAMBER now U.S. Pat. No. 9,027,201 and which was a national phase entry of PCT/CA2008/001530 which claimed priority from CA2,599,303; and is (c) a continuation-in-part of U.S. patent application Ser. No. 12/675,636 filed Feb. 26, 2010 entitled CYCLONIC SURFACE CLEANING APPARATUS WITH SEQUENTIAL FILTRATION MEMBERS which is abandoned and which was a national phase entry of PCT/CA2008/001519 which claimed priority from CA2,599,303;

(2) and U.S. patent application Ser. No. 14/475,219 is also a continuation-in-part of U.S. patent application Ser. No. 14/036,818 filed on Sep. 25, 2013, now U.S. Pat. No. 9,301,662 which itself is a continuation of application Ser. No. 13/396,918, filed on Feb. 15, 2012, now U.S. Pat. No. 8,567,006, which is a continuation of application Ser. No. 11/954,310, filed on Dec. 12, 2007, now U.S. Pat. No. 8,166,607, which claims priority from U.S. provisional application No. 60/869,586, filed on Dec. 12, 2006 each of which is incorporated herein by reference in its entirety.

FIELD

The specification relates to surface cleaning apparatus such as vacuum cleaners. In a preferred embodiment, the specification relates to cyclonic hand vacuum cleaners.

INTRODUCTION

The following is not an admission that anything discussed below is prior art or part of the common general knowledge of persons skilled in the art.

PCT publication WO 2008/009890 (Dyson Technology Limited) discloses a handheld cleaning appliance comprising a main body, a dirty air inlet, a clean air outlet and a cyclonic separator for separating dirt and dust from an airflow. The cyclone separator is located in an airflow path leading from the air inlet to the air outlet. The cyclonic separator is arranged in a generally upright orientation (i.e., the air rotates about a generally vertical axis in use). A base surface of the main body and a base surface of the cyclonic separator together form a base surface of the appliance for supporting the appliance on a surface. See also PCT publication WO 2008/009888 (Dyson Technology Limited) and PCT publication WO 2008/009883 (Dyson Technology Limited).

U.S. Pat. No. 7,370,387 (Black & Decker Inc.) discloses a hand-holdable vacuum cleaner that uses one or more filters and/or cyclonic separation device. and means for adjusting an angle of air inlet relative to a main axis of said vacuum cleaner. In particular, the vacuum cleaner further comprises a rigid, elongate nose having the air inlet at one end thereof, the nose being pivotal relative to a main axis of the vacuum cleaner through an angle of at least 135 degrees.

SUMMARY

The following introduction is provided to introduce the reader to the more detailed discussion to follow. The introduction is not intended to limit or define the claims According to one broad aspect, a surface cleaning apparatus and, preferably a cyclonic hand vacuum cleaner and/or a surface cleaning unit that is removably mounted to an upright support structure that is pivotally mounted to a cleaning head is provided wherein at least part, and preferably a substantial portion, of the air flow path between components of the surface cleaning apparatus is linear. Accordingly, one or more components of the vacuum cleaner may be arranged such that the air outlet of an upstream component faces the air inlet of a downstream component. In a preferred embodiment, the outlet from a cyclone is oriented such that the air may travel generally linearly to the inlet of a suction motor. This may be achieved by orienting the axis of a cyclone such that the cyclone axis is generally parallel to the axis of the suction motor. If the hand vacuum cleaner has more than one cyclonic stage, then the outlet of the last pre-motor cyclone or cyclones is preferably oriented such that the air may travel generally linearly to the inlet of a suction motor. It will be appreciated that one or more pre-motor filters may be positioned between the cyclone outlet and the suction motor inlet. Preferably, the air flow through the pre-motor filter or filters is generally linear. It will be appreciated that the air outlet of other components (e.g., a cyclone, filter or suction motor) may also be oriented such that the air may travel generally linearly to the inlet of the next downstream component (e.g., a cyclone, filter or suction motor).

An advantage of this design is that the backpressure in the airflow path through the hand vacuum cleaner may be reduced. Accordingly, the airflow rate through the hand vacuum cleaner may be increased without increasing the size (and weight) of the suction motor. Alternately, or in addition, a smaller motor may be used with decreasing the airflow rate through the hand vacuum cleaner.

In accordance with one broad aspect of the teachings described herein, a hand vacuum cleaner can include a front end and a rear end, an air flow passage extending from a dirty air inlet to a clean air outlet and a first cyclone unit positioned in the air flow passage. The first cyclone unit can include at least one cyclone having a cyclone inlet and an outlet passage positioned in the cyclone chamber that has a direction of flow and at least one dirt collection chamber. A pre-motor filter may be positioned in the air flow passage downstream from the outlet passage, and a suction motor may be positioned in the air flow passage downstream from the pre-motor filter. The air flow passage may include an air flow path portion that extends from the outlet passage to the clean air outlet. The air flow path portion may be generally linear, and the at least one cyclone may have a cyclone axis extending longitudinally through the at least one cyclone. The hand vacuum cleaner may have an axis extending from the front end to the rear end and the cyclone axis is generally parallel to the axis of the hand vacuum cleaner.

The at least one cyclone may have a cyclone axis extending longitudinally through the at least one cyclone. The suction motor may have a motor axis extending generally parallel to the axis of rotation of a suction fan and the cyclone axis is generally parallel to the motor axis.

The dirt collection chamber may have an openable door provided at a front end of the first cyclone unit.

The at least one cyclone may have a cyclone front end, a cyclone rear end and the cyclone air inlet and the cyclone air outlet may be at the same end of the at least one cyclone.

The cyclone air inlet and the cyclone air outlet may be at the cyclone rear end.

The at least one dirt collection chamber may be openable when mounted to the hand vacuum cleaner.

The pre-motor filter may be positioned facing the outlet passage and having a pre-motor filter air inlet and a pre-motor filter air outlet, the suction motor has a motor axis extending generally parallel to the axis of rotation of a suction fan and the pre-motor filter air inlet and the pre-motor air outlet are generally transverse to the motor axis.

A post motor filter may have a post motor filter air inlet and a post motor filter air outlet. The suction motor may have a motor axis extending generally parallel to the axis of rotation of a suction fan and the post motor filter air inlet and the post motor filter air outlet are generally transverse to the motor axis.

The pre-motor filter may have a pre-motor filter air inlet and a pre-motor filter air outlet and the hand vacuum cleaner further comprises a post motor filter having a post motor filter air inlet and a post motor filter air outlet, and the pre-motor filter air inlet, the pre-motor air outlet, the post motor filter air inlet and the post motor air outlet may be aligned.

The hand vacuum cleaner may also include a post motor filter positioned downstream from the suction motor and comprising an air outlet at the rear end of the hand vacuum cleaner.

The first cyclone unit may consists essentially of a single cyclone and a single dirt collection chamber.

The hand vacuum cleaner may include comprising a second cyclone unit downstream from the first cyclone unit.

The second cyclone unit may have a second cyclone air inlet having a direction of flow and a second cyclone air outlet having a direction of flow and the direction of flow through the second cyclone air inlet and the second cyclone air outlet may be in the same direction as the direction of air flow through the outlet passage.

The at least one cyclone may have a cyclone axis extending longitudinally through the at least one cyclone and air exiting the clean air outlet travels in a direction that is generally parallel to the cyclone axis.

In accordance with another broad aspect of the teachings describe herein, which may be used along or in combination with any other aspects, a surface cleaning apparatus may include an air flow passage extending from a dirty air inlet to a clean air outlet, a floor cleaning unit comprising a surface cleaning head and a handle drivingly connected thereto and a surface cleaning unit removably mounted to the floor cleaning unit. The surface cleaning unit may include a first cyclone unit positioned in the air flow passage. The first cyclone unit may include at least one cyclone comprising a cyclone inlet, a cyclone axis and an axially extending outlet conduit and at least one dirt collection chamber. A pre-motor filter may be positioned in the air flow passage downstream from the conduit. A suction motor may be positioned in the air flow passage downstream from the pre-motor filter. The air flow passage may include a first air flow path portion that extends from the outlet conduit to the suction motor, wherein the air flow path portion is generally linear, and a second air flow path portion comprising a flexible conduit providing air flow communication between the surface cleaning head and the surface cleaning unit when the surface cleaning unit is mounted to the floor cleaning unit and removable with the surface cleaning unit when the surface cleaning unit is removed from the floor cleaning unit.

The surface cleaning unit may be operable when removed from the floor cleaning unit.

The first cyclone unit may have a portion that is openable or removable and the portion is located at an upper end of the first cyclone unit.

The surface cleaning unit may be removably mounted to the handle.

The surface cleaning unit may include a first end, a second end axially spaced apart from the first end and a side wall extending between the first and second ends, and may also include a cleaning unit handle extending from the sidewall.

The first cyclone unit may have a first end wall at the first end and wherein at least a portion of the first end wall is openable to empty the dirt collection chamber.

The surface cleaning apparatus may also include a second end wall at the second end and wherein the second end wall comprises the clean air outlet.

Air exiting the suction motor may travel in a direction that is generally linear with the first air flow path portion.

The surface cleaning apparatus may include a post motor filter and the air flow path from a suction motor outlet to a post motor filter inlet is generally linear and axial with the first air flow path portion.

Air exiting the post motor filter may travel in a direction that is generally linear with the first air flow path portion.

The flexible conduit may include an electrified stretch hose providing an electrical connection between the surface cleaning unit and the surface cleaning head.

In accordance with another broad aspect of the teachings described herein, which may be used alone or in combination with any other aspects, a upright surface cleaning apparatus may include an air flow passage extending from a dirty air inlet to a clean air outlet, a floor cleaning unit having a surface cleaning head and a handle drivingly connected thereto, and a first cyclone unit supported by the handle and in the air flow passage. The first cyclone unit may include at least one cyclone comprising a cyclone inlet, an internal conduit extending in a first direction and defining an outlet passage and at least one dirt collection chamber. A pre-motor filter may be positioned in the air flow passage downstream from the internal conduit. A suction motor may be downstream from the pre-motor filter and the air flow passage may include an air flow path portion that extends from the internal conduit to the suction motor, wherein the air flow path portion that is generally linear and wherein air exiting the clean air outlet travels in a direction that is generally parallel to the first direction.

The cyclone unit may be mounted to the handle and the suction motor may be supported by the handle below the first cyclone unit.

The cyclone unit may be mounted to a suction motor housing.

The air flow passage may include a portion extending from the surface cleaning head to the first cyclone unit and the portion comprises a flexible conduit.

The first cyclone unit may have a portion that is openable or removable and the portion is located at an upper end of the first cyclone unit.

In accordance with another broad aspect of the teachings described herein, which may be used alone or in combination with another aspect, a surface cleaning apparatus comprising may include an air flow passage extending from a dirty air inlet to a clean air outlet, a floor cleaning unit comprising a surface cleaning head and a handle drivingly connected thereto and a surface cleaning unit removably mounted to the floor cleaning unit. The first cyclone unit may include a first cyclone unit positioned in the air flow passage. The first cyclone unit may include at least one cyclone comprising a cyclone inlet, a cyclone axis and an axially extending air outlet conduit and at least one dirt collection chamber. A pre-motor filter may be positioned in the air flow passage downstream from the conduit. A suction motor may be positioned in the air flow passage downstream from the pre-motor filter. The motor may include a motor axis that is substantially parallel to the cyclone axis. The air flow passage may include a first air flow path portion that extends from the air outlet conduit to the suction motor wherein air exiting the air outlet conduit travels in the axial direction and air entering the suction motor travels in the axial direction, and a second air flow path portion comprising a flexible conduit providing air flow communication between the surface cleaning head and the surface cleaning unit when the surface cleaning unit is mounted to the floor cleaning unit and removable with the surface cleaning unit when the surface cleaning unit is removed from the floor cleaning unit.

The first air flow path portion may include a pre-motor filter chamber containing the pre-motor filter, and may be linear.

It will be appreciated that the vacuum cleaner may incorporate one or more of the features of each of these examples.

DRAWINGS

In the detailed description, reference will be made to the following drawings, in which.

DESCRIPTION OF VARIOUS EXAMPLES

Figure 1:
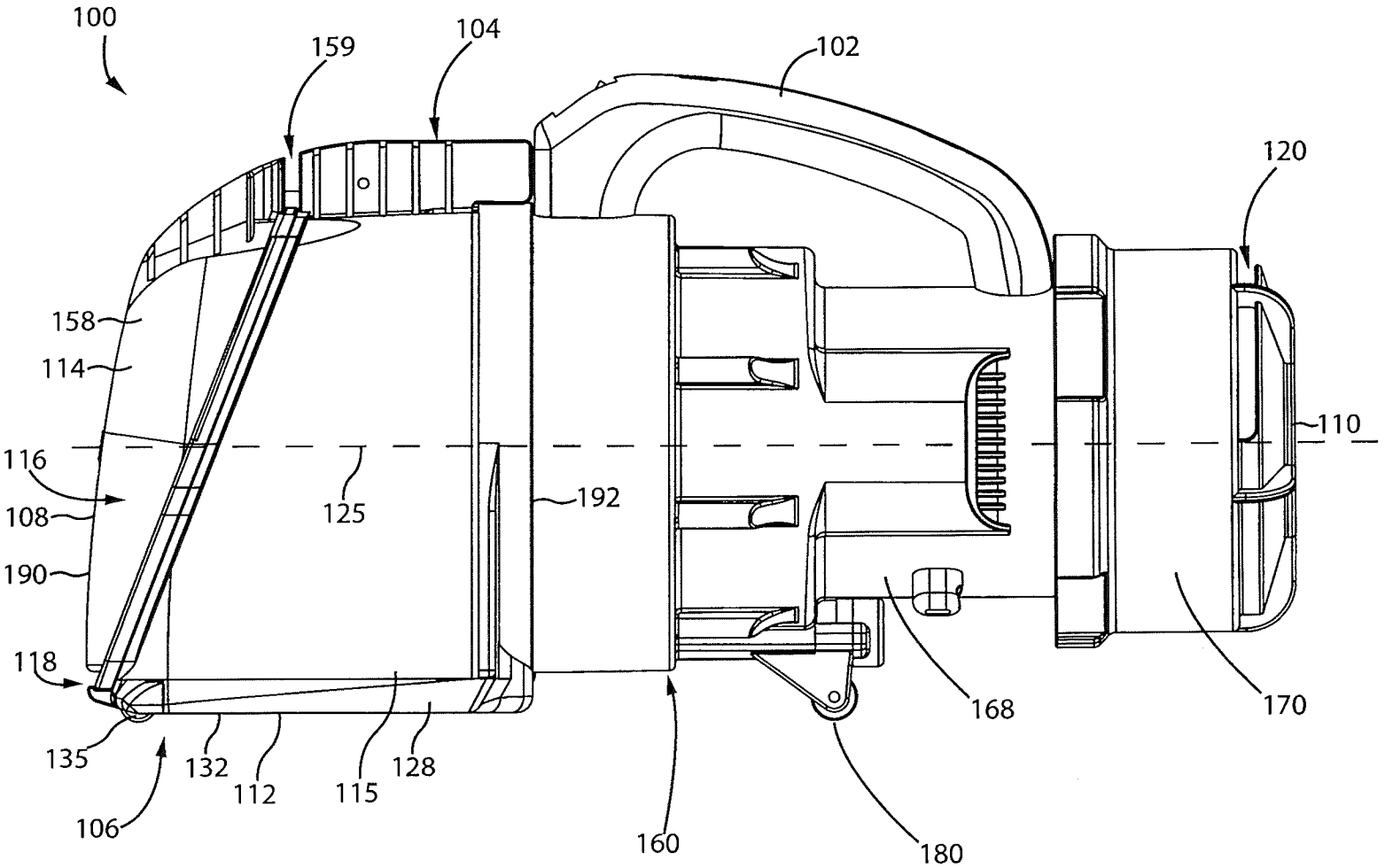
FIG. 1 is a side plan view of an example of a surface cleaning unit.
Figure 2:
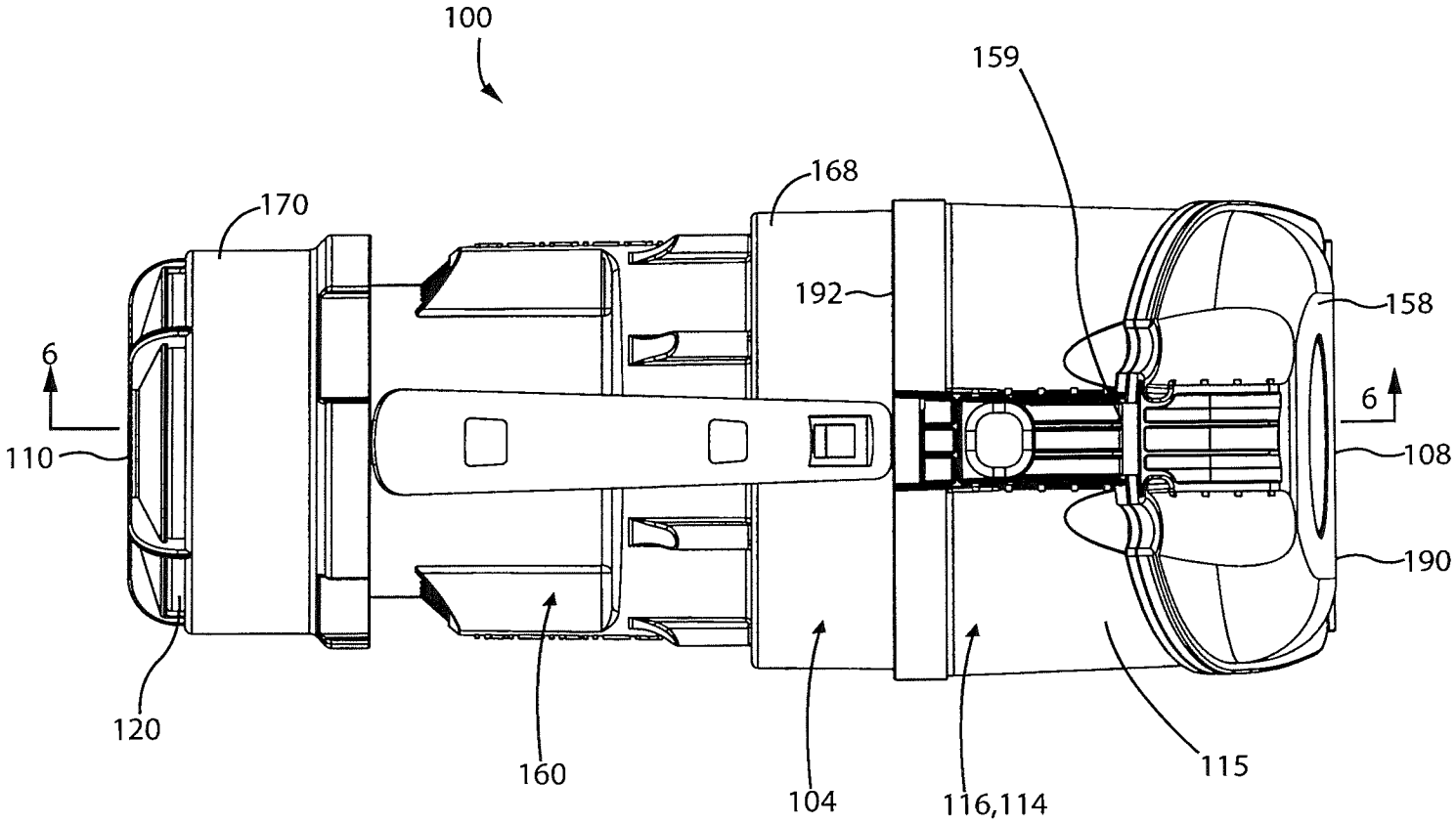
FIG. 2 is a top plan view of the surface cleaning unit of FIG. 1.

Various apparatuses or methods will be described below to provide an example of each claimed invention. No example described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention.

In the drawings attached hereto, the hand vacuum cleaner is exemplified as comprising one or two cyclonic stages. It will be appreciated that the vacuum cleaner 100 may be of various configurations (e.g., different positioning of the cyclonic stages and the suction motor and differing cyclonic stages that may comprise one or more cyclones and one or more filters).

Referring to FIGS. 1 to 7, a first example of a surface cleaning unit 100 is shown. In the embodiment shown, the surface cleaning unit 100 (also referred to herein as vacuum cleaner 100 or cleaner 100) is usable as a vacuum cleaner 100, and more particularly a hand vacuum cleaner 100. The vacuum cleaner 100 is movable along a surface to be cleaned by gripping and maneuvering handle 102. The vacuum cleaner includes an upper portion 104, a lower portion 106, a front end 108, and a rear end 110. A longitudinal axis 125 of the vacuum cleaner 100 extends between the front end 108 and the rear end 110. In the example shown, handle 102 is provided at the upper portion 104. In alternate examples, handle 102 may be provided elsewhere on the vacuum cleaner 100, for example at the rear 110 and may be of any design.

In the example shown, the vacuum cleaner 100 comprises a nozzle 112 and a cyclone unit 114, which together preferably form a surface cleaning head 116 of the vacuum cleaner 100. In the example shown, the surface cleaning head 116 is preferably provided at the front end 108 of the vacuum cleaner 100.

Nozzle 112 engages a surface to be cleaned, and comprises a dirty air inlet 118, through which dirty air is drawn into the vacuum cleaner 100. An airflow passage extends from the dirty air inlet 118 to a clean air outlet 120 of the cleaner 100. In the example shown, clean air outlet 120 is at the rear 110 of the cleaner 100.

Cyclone unit 114 is provided in the airflow passage, downstream of the dirty air inlet 118. Cyclone unit 116 has a front end 190, and a rear end 192. In the example shown, the cyclone unit 114 is a one piece assembly comprising one cyclone 122, and one dirt collection chamber 124, which are integrally formed. In alternate examples, as will be described hereinbelow with respect to FIG. 8, the cyclone unit 110 may include more than one cyclonic stage, wherein each cyclonic stage comprises one or more cyclones and one or more dirt chambers. Accordingly, the cyclones may be arranged in parallel and/or in sequence. Further, in alternate examples, the cyclone 122 and dirt collection chamber 124 may be separately formed.

In the example shown, the nozzle 112 is positioned at the lower portion 106 of the vacuum cleaner 100. Preferably, as exemplified, nozzle 112 is positioned at the bottom of the vacuum cleaner 100, and, preferably, beneath the cyclone unit 114. However, it will be appreciated that nozzle 112 may be connected to the cyclone unit or dirt collection chamber at alternate locations.

Figure 6:
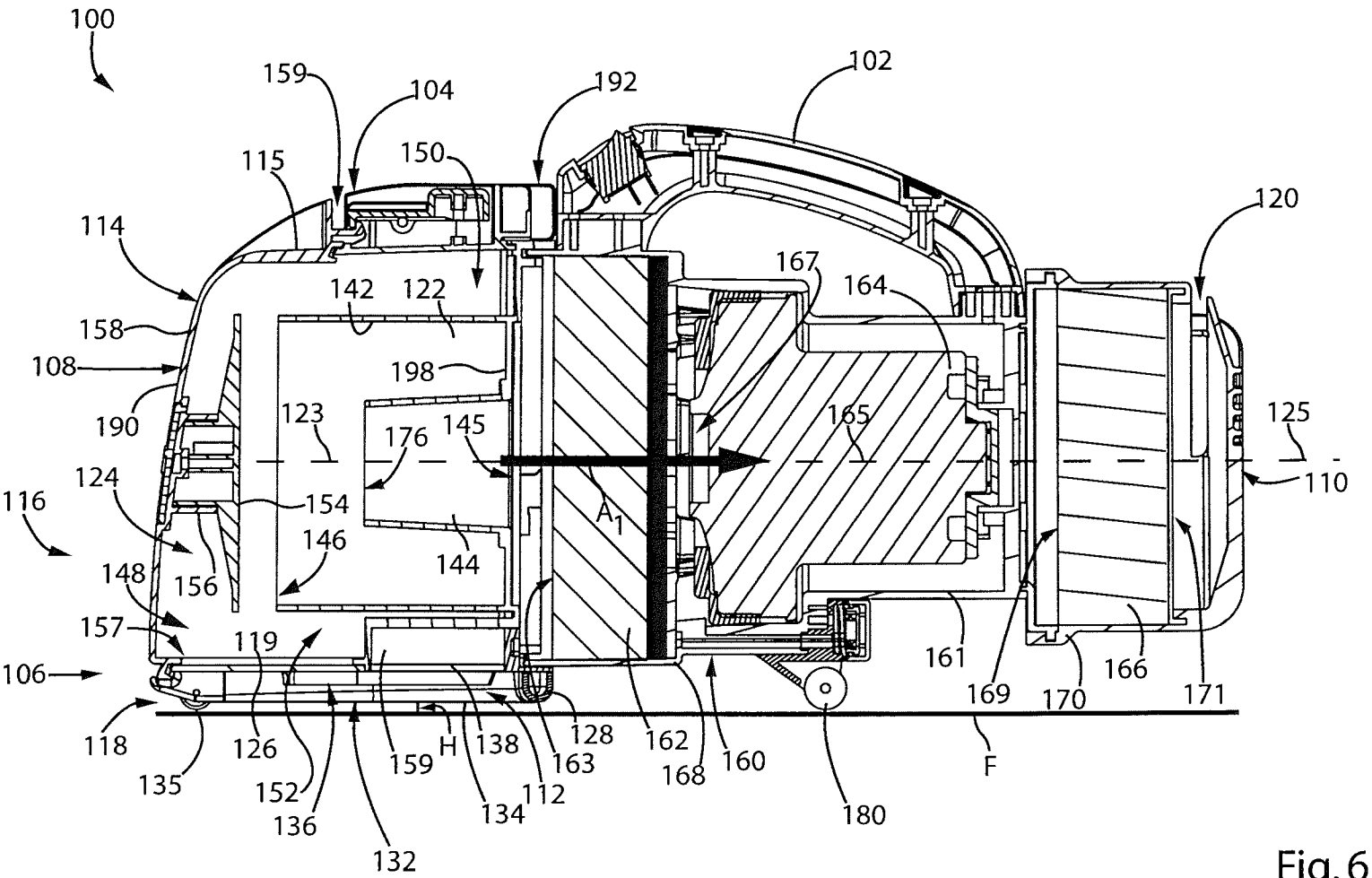
FIG. 6 is a cross section taken along line 6-6 in FIG. 2.
Figure 7:
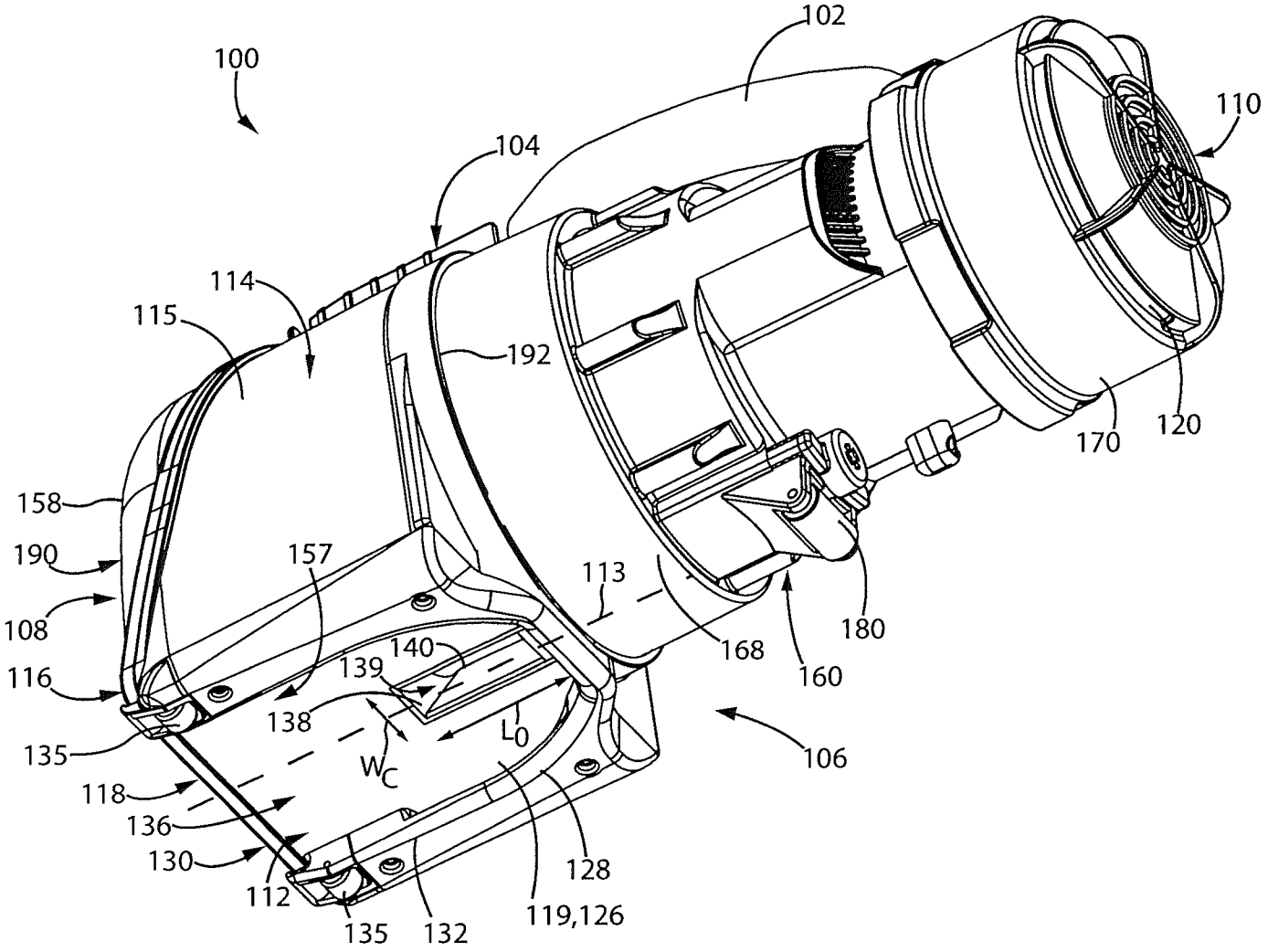
FIG. 7 is a bottom perspective view of the surface cleaning unit of FIG. 1.

Preferably, as exemplified, nozzle 112 may be on lower surface 157 of cyclone unit 114 and may share a wall with the cyclone unit 114. For example, in a particularly preferred design, the upper wall 126 of the nozzle 112 may be a lower wall of the cyclone unit 114. As shown in FIG. 6, dirt chamber 124 surrounds the lower portion of cyclone 122. Accordingly, the upper wall of nozzle 112 may be part of the lower wall of the dirt chamber. It will be appreciated that if dirt chamber 124 does not extend around the lower portion of cyclone 122, then the upper wall of nozzle 112 may be part of a lower wall of cyclone 122.

Preferably, in the example shown, the nozzle 112 is fixedly positioned at the lower portion 106 of the vacuum cleaner 100. That is, the nozzle 112 is not movable (e.g., rotatable) with respect to the remainder of the vacuum cleaner 100, and is fixed at the lower portion 106 of the vacuum cleaner 100.

Figure 3:
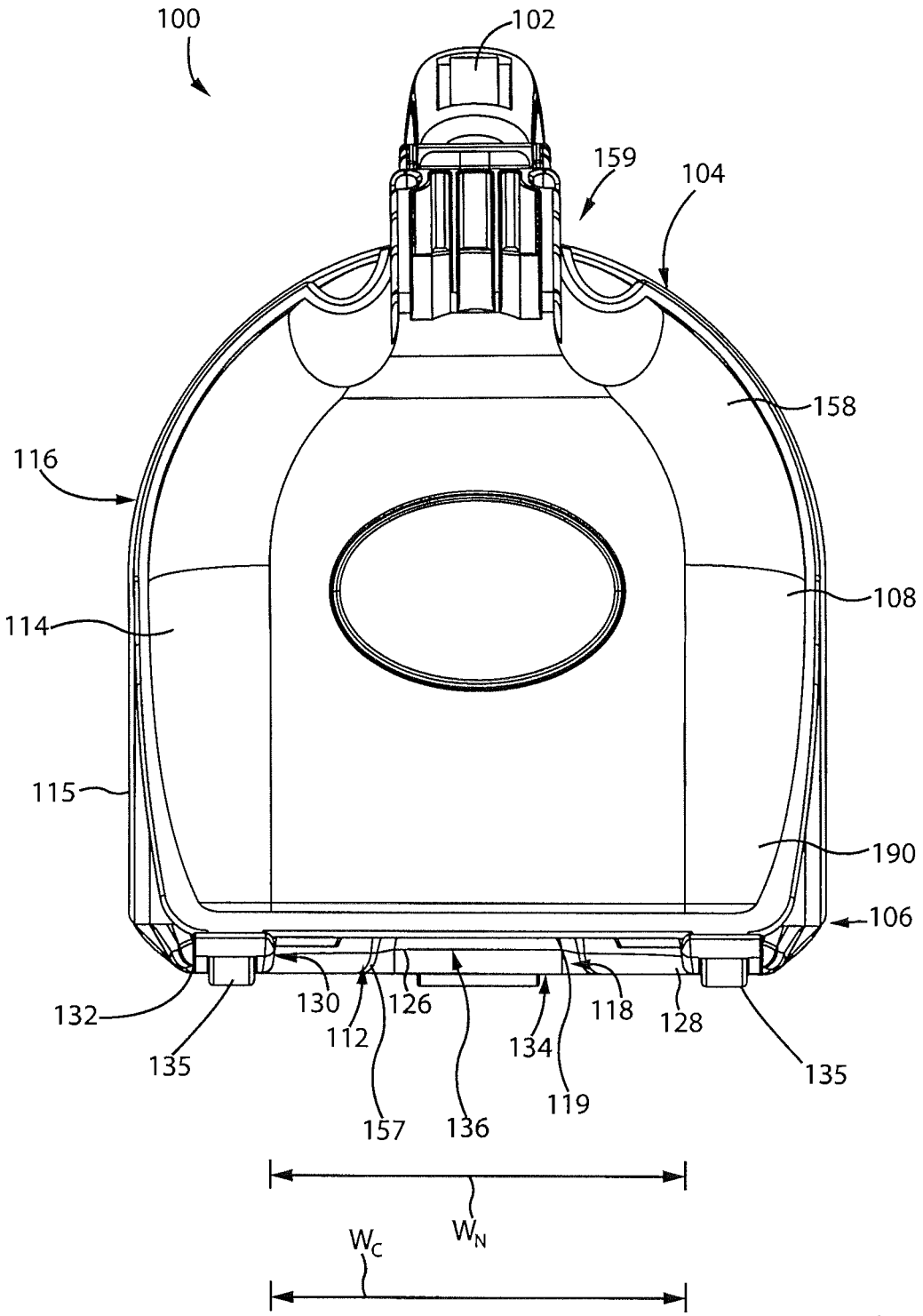
FIG. 3 is a front plan view of the surface cleaning unit of FIG. 1.
Figure 4:
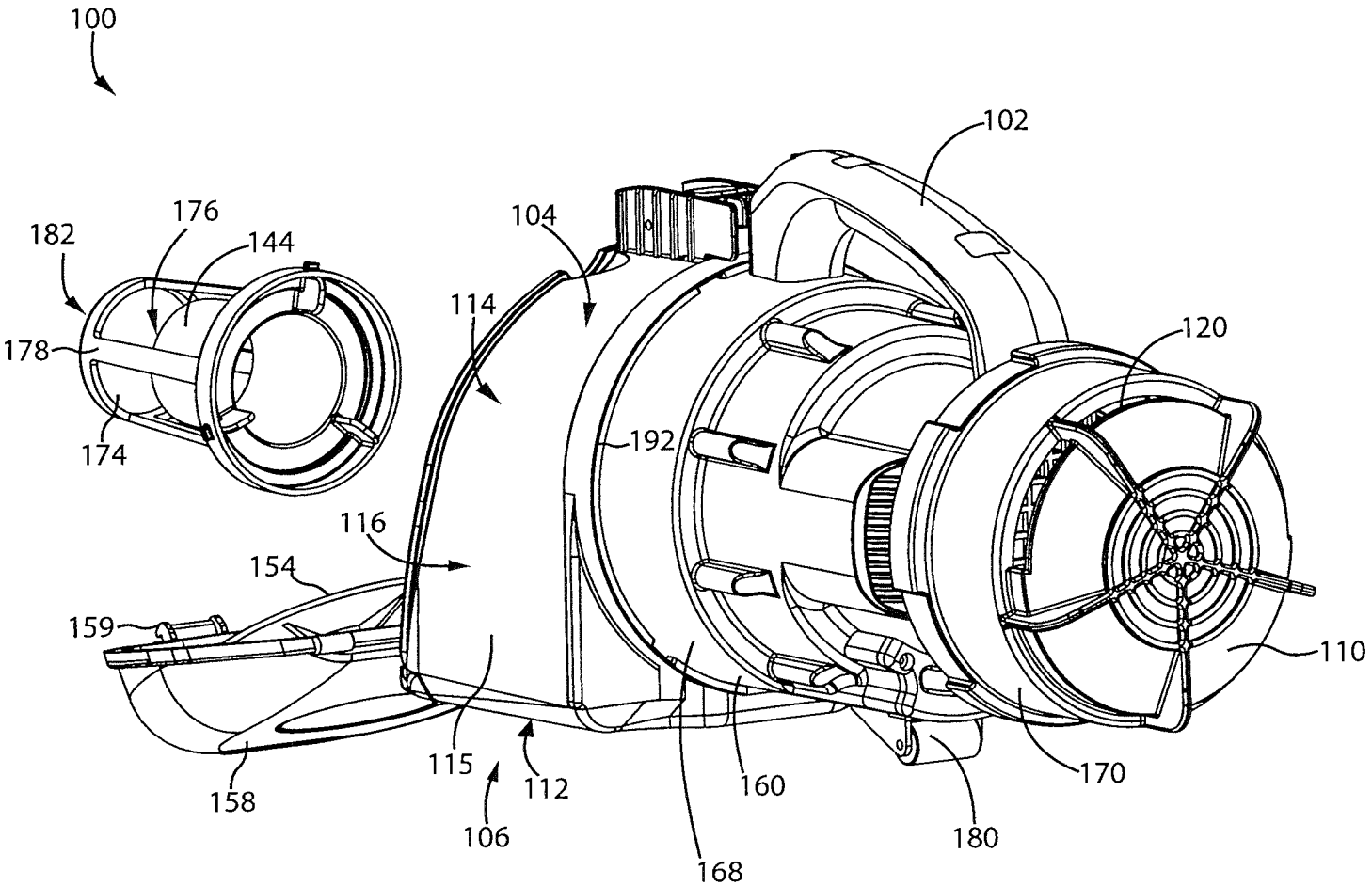
FIG. 4 is a partially exploded rear perspective view of the surface cleaning unit of FIG. 1.
Figure 5:
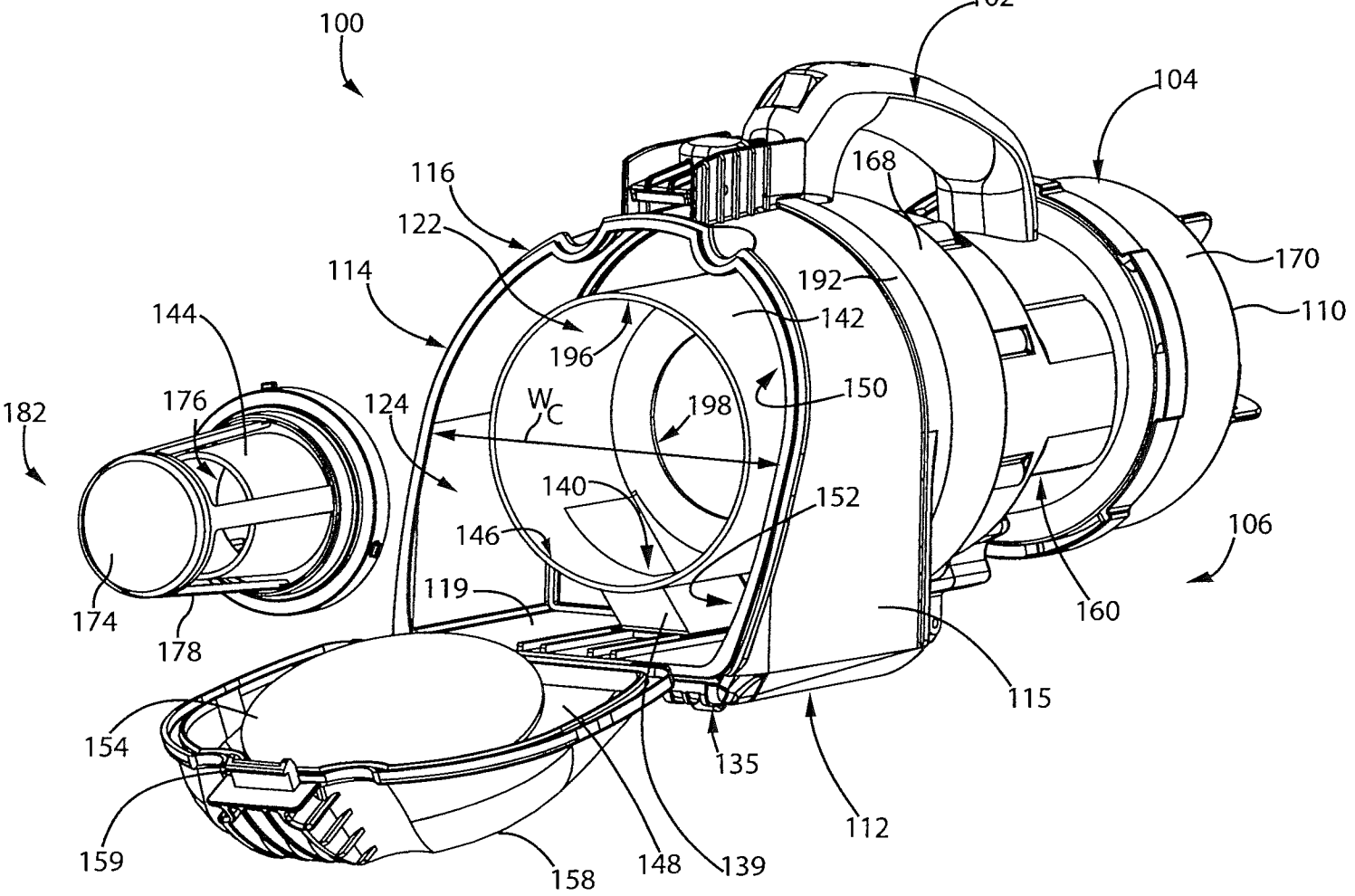
FIG. 5 is a partially exploded front perspective view of the surface cleaning unit of FIG. 1.

As shown in FIGS. 3 and 5, nozzle 112 has a width $W_N$, and cyclone unit 114 has a width $W_C$. In the example shown, $W_N$, and $W_C$ are about the same. An advantage of this design is that the nozzle 112 may have a cleaning path that is essentially as wide as the hand vacuum itself.

Preferably, nozzle 112 comprises an airflow chamber 136 wherein at least a portion, and preferably a majority, of the lower surface 134 of the chamber is open. In an alternate design as exemplified by FIG. 8, nozzle 812 comprises a lower wall 837, which closes lower end 834. Accordingly, nozzle 112 may be of various designs and may be an open sided passage or a closed passage. In either embodiment, it will be appreciated that nozzle 112 may be mounted or provided on cyclone unit 114 and as exemplified on a lower portion of the dirt collection chamber so as to be removable with the dirt collection chamber An open sided design is exemplified in FIG. 7A wherein nozzle 112 comprises an upper nozzle wall 126. In the example shown, the upper nozzle wall 126 comprises a portion 119 of a wall 115 of the cyclone unit.

Preferably, one or more depending walls 128 extend downwardly from the upper nozzle wall 126. The depending wall is preferably generally U-shaped. In one embodiment, a depending wall 128 is provided rearward of opening 138. In other embodiments, depending walls may alternately or in addition be provided on the lateral sides of opening 138. It is preferred that the depending walls may be continuous to define a single wall as shown, or may be discontinuous. The depending walls may be provided on each lateral side of opening 138 and rearward thereof. Further, depending walls 128 may extend a substantial distance to the front end 108 and, preferably, essentially all the way to front end 108. The depending wall 128 may be continuous to define a single wall as shown, or may be discontinuous. The depending wall is preferably rigid (e.g., integrally molded with cyclone unit 114). However, they may be flexible (e.g., bristles or rubber) or moveably mounted to cyclone unit 114 (e.g., hingedly mounted).

Preferably, the lower end 132 of depending wall 128 is spaced above the surface being cleaned when the hand vacuum cleaner is placed on a surface to be cleaned. As exemplified in FIG. 6, when vacuum cleaner 100 is placed on a floor F, lower end 132 of depending wall 128 is spaced a distance H above the floor. Preferably distance H is from 0.01 inches to 0.175 inches, more preferably from 0.04 to 0.08 inches.

The height of the depending wall 128 (between upper nozzle wall 126 and lower end 132) may vary. In some examples, the depending wall may have a height of between about 0.05 and about 0.875 inches, preferably between about 0.125 and about 0.6 inches and more preferably between about 0.2 and about 0.4 inches. The height of depending wall 128 may vary but is preferably constant.

As exemplified, the open end of the U-shape defines an open side 130 of the nozzle 114, and forms the dirty air inlet 118 of the cleaner 100. In the example shown, the open side 130 is provided at the front of the nozzle 114. In use, when optional wheels 135 are in contact with a surface, the open side 130 sits above and is adjacent a surface to be cleaned (e.g. floor F). As mentioned hereinabove, preferably, lower end 132 of depending walls 128 is spaced above floor F. Accordingly, some air may enter nozzle 114 by passing underneath depending wall 132. In such a case, the primary air entry to nozzle 114 is via open side 130 so that dirty air inlet 118 is the primary air inlet, with a secondary air inlet being under depending wall 128.

In the example shown, the lower end 132 of the depending wall 128 defines an open lower end 134 of the nozzle 114. The open lower end 134 preferably extends to the front 108 of the cleaner 100, and merges with the open side 130. In use, the exemplified nozzle 112 has an open lower end 134 that faces a surface to be cleaned.

In the example shown, a plurality of wheels 135 are mounted to the depending wall 128, and extend lower than the lower end 132 of the depending wall 128. Accordingly, in use, when wheels 135 are in contact with a surface, the lower end 132 of the depending wall 128 is spaced from the surface to be cleaned, and the space between the lower end of the depending wall 128 and the surface to be cleaned form the secondary dirty air inlet to the vacuum cleaner 100. It will be appreciated that wheels 135 are optional. Preferably, wheels 135 are positioned exterior to the airflow path through nozzle 112, e.g., laterally outwardly from depending wall 128. Preferably a pair of front wheels 135 are provided. Preferably, the wheels are located adjacent front 108. Optionally, one or more rear wheels 180 may be provided. In an alternate embodiment, no wheels may be provided.

The upper nozzle wall 126, depending wall 128, and open lower end 134 of the nozzle 112 define open sided airflow chamber 136 of the nozzle. In use, when wheels 135 are in contact with a horizontal surface, the nozzle 112 and the airflow chamber 136 preferably extend generally horizontally, and preferably linearly along a nozzle axis 113 (see FIG. 7).

An opening 138 maybe provided in the upper nozzle wall 126, and is in communication with the airflow chamber 136. Opening 138 may be of any size and configuration and at various locations in upper nozzle wall 126. In use, when wheels 135 are in contact with a surface, the opening 138 faces a surface to be cleaned, air enters the dirty air inlet 118, passes horizontally through the airflow chamber 136, and passes into the opening 138. Opening 138 is in communication with a cyclone inlet passage 139, which is in communication with a cyclone inlet 140 of cyclone 122.

As exemplified in FIGS. 1-7, a single cyclone is used. As exemplified therein, the direction of air exiting the outlet of cyclone 122 is the same as the direction of airflow immediately upstream of the suction motor 164. Further, while an optional pre-filter 162 is positioned between the cyclone air outlet 145 and the suction motor 162, the front and rear face of the pre-motor filter are each preferably transverse to the direction of airflow leaving the cyclone outlet 145. Further, the direction of airflow through the pre-motor filter 162 is preferably in the same direction as the air leaving the cyclone outlet 145. Accordingly, in this preferred embodiment, while the air may spread out or converge as it travels through the pre-motor filter 162, some and preferably all of the air continues to generally travel in the same direction, namely rearwardly.

It will be appreciated that cyclone 122 may of any configuration and orientation. Preferably, cyclone 122 comprises a chamber wall 142, which in the example shown, is cylindrical. The cyclone chamber is located inside chamber wall 142. The cyclone 122 extends along an axis 123, which, in the example shown, is preferably parallel to the nozzle axis, and/or preferably parallel to the cleaner axis 125. Axis 123 preferably extends generally horizontally when cleaner 100 is in use and wheels 135 are seated on a surface. Cyclone 122 has a front end 196, and a rear end 198. In the example shown, the front end 196 of the cyclone 122 is proximate the front end 108 of the vacuum cleaner 100.

Preferably, the cyclone air inlet 140 and the cyclone air outlet 145 are at the same end of the cyclone 122 and the dirt outlet 146 is at an opposed end. The cyclone air outlet 145 may be covered by a screen or shroud or filter as is known in the art. As exemplified, the cyclone air inlet 140 is defined by an aperture in the chamber wall 142. The cyclone inlet 140 is preferably at the rear end 198 of the cyclone 122. As can be seen in FIG. 5, the inlet passage 139 is configured such that air enters the cyclone 122 in a tangential flow path, e.g., passage 139 may be arcuate. The air travels in a cyclonic path in the cyclone 122, and dirt in the air is separated from the air. The air exits the cyclone via an outlet passage 144, through outlet 145. Outlet 145 is preferably at the rear end 198 of the cyclone. Accordingly, inlet 140 and outlet 145 are at the same end of the cyclone.

As exemplified in FIG. 6, a plate 174 may be provided adjacent outlet passage 144, spaced from and facing the inlet 176 to outlet passage 144. Plate 174 may be mounted to cyclone 122 via legs 178. In the example shown, plate 174, and legs 178 form an assembly 182 that is removably mounted in cyclone 122. In some examples, a screen may be mounted around legs 178.

The dirt that is separated from the air exits the cyclone via dirt outlet 146, and enters dirt collection chamber 124. Dirt outlet is preferably at the front 196 of the cyclone 122, and further, is at the front end 108 of the cleaner 100. The dirt collection chamber 124 may be internal or external to the cyclone chamber. Preferably, as exemplified, the dirt collection chamber is external. The dirt collection chamber 124 may be in communication with the cyclone chamber 122 by any means known in the art. Accordingly, one or more dirt outlets may be provided. Preferably, the dirt outlet is at the end opposed to the air inlet and, preferably, the dirt outlet is at the front end 108.

In the example shown, dirt collection chamber 124 preferably comprises two portions. A first portion 148 is provided immediately adjacent the dirt outlet 146, and is at the front end 108 of the cleaner 100. A second portion 150 is concentric with the cyclone 122. A lower portion 152 of the second portion 150 is below the cyclone. As exemplified, nozzle 112 is positioned below first portion 148, and lower portion 152. Accordingly, dirt chamber 124 may comprise an annular chamber surrounding the cyclone 122.

A separation plate 154 may be provided in the dirt collection chamber 124, and may be mounted in facing relation to the dirt outlet 146. The separation plate 154 aids in preventing dirt in dirt chamber 124 from re-entering cyclone 122. Preferably, plate 154 is spaced from dirt outlet 146. Plate 154 may be mounted by any means to any component in cyclone unit 114. As exemplified, the separation plate may be mounted on an arm 156, which extends from a front wall 158 at the front end 190 of the cyclone unit 114.

Cyclone unit 114 may be emptied by any means known in the art. For example, one of the ends of the cyclone unit 114 may be openable and/or removable. The end may open cyclone chamber as well as the dirt collection chamber. As exemplified in FIGS. 4 and 5, front wall 158 is pivotally mounted to the cyclone unit wall 115, and provides an openable door of the cyclone unit 114. Accordingly, cyclone unit 114 may be opened, and dirt chamber 124 may be emptied. The dirt collection chamber 124 is preferably openable both when the dirt collection chamber 124 is mounted to the hand vacuum cleaner, or when it is optionally removed, as will be described hereinbelow. If a plate 124 is provided on the front wall, then when front wall 158 is pivoted away from the remainder of the cyclone unit 114, separation plate 154 and arm 156 also pivot away from the remainder of the cyclone unit. A latch 159 or other securing member or members may be provided, which secure front wall 158 to wall 115. In alternate examples, front wall 158 may be removable from cyclone unit wall 115, or the rear wall 179 of the cyclone unit 114 may be openable or removable. In an alternate embodiment, only the dirt chamber may be removable.

The rear portion of the dirt collection chamber 124 may be closed by wall 179.

The clean air exiting cyclone 122 passes through outlet 145 of outlet passage 144, exits surface cleaning head 116, and passes into the cleaner body 160. In the example shown, the cleaner body 160 is downstream of the surface cleaning head 116, and positioned rearward of the surface cleaning head 116. The cleaner body comprises a suction motor housing 168, which houses an optional pre-motor filter 162, a suction motor 164 and may house an optional post-motor filter 166. As can be seen in FIG. 6, the air flow passage includes a generally linear airflow path (indicated by arrow A1) between outlet 145 and suction motor 164. That is, the air flow passage does not comprise significant bends between outlet 145 and suction motor 164.

In the example shown, suction motor housing 168 further houses a pre-motor filter 162. One or more filters may be used. Pre-motor filter 162 is provided in the airflow path preferably adjacent and downstream of the outlet passage 144, and preferably facing the outlet 145. Pre-motor filter 162 has an inlet 163, and an outlet 167. Pre-motor filter 162 serves to remove remaining particulate matter from air exiting the cyclone 122, and may be any type of filter, such as a foam filter. As can be seen in FIG. 6, the cyclone unit 114, the pre motor filter 162, and the suction motor 164 are arranged linearly.

Suction motor 164 is provided in the airflow path adjacent and downstream of the pre-motor filter 162. The suction motor 164 may be any type of suction motor. The suction motor draws air into the dirty air inlet 118 of the cleaner 100, through the airflow path past the suction motor 164, and out of the clean air outlet 120. The suction motor 164 has a motor axis 165, which is generally parallel to the axis of rotation of a suction fan (not shown) of the suction motor. In the example shown, the motor axis 165 and the cyclone axis 123 extend in the same direction and are generally parallel. Further, in the example shown, the inlet 163 and the outlet 167 of the pre-motor 162 filter are generally transverse to the motor axis 165. That is, the inlet 163 and the outlet 167 of the pre-motor filter 162 are defined in planes that are transverse to the motor axis 165.

Figure 8:
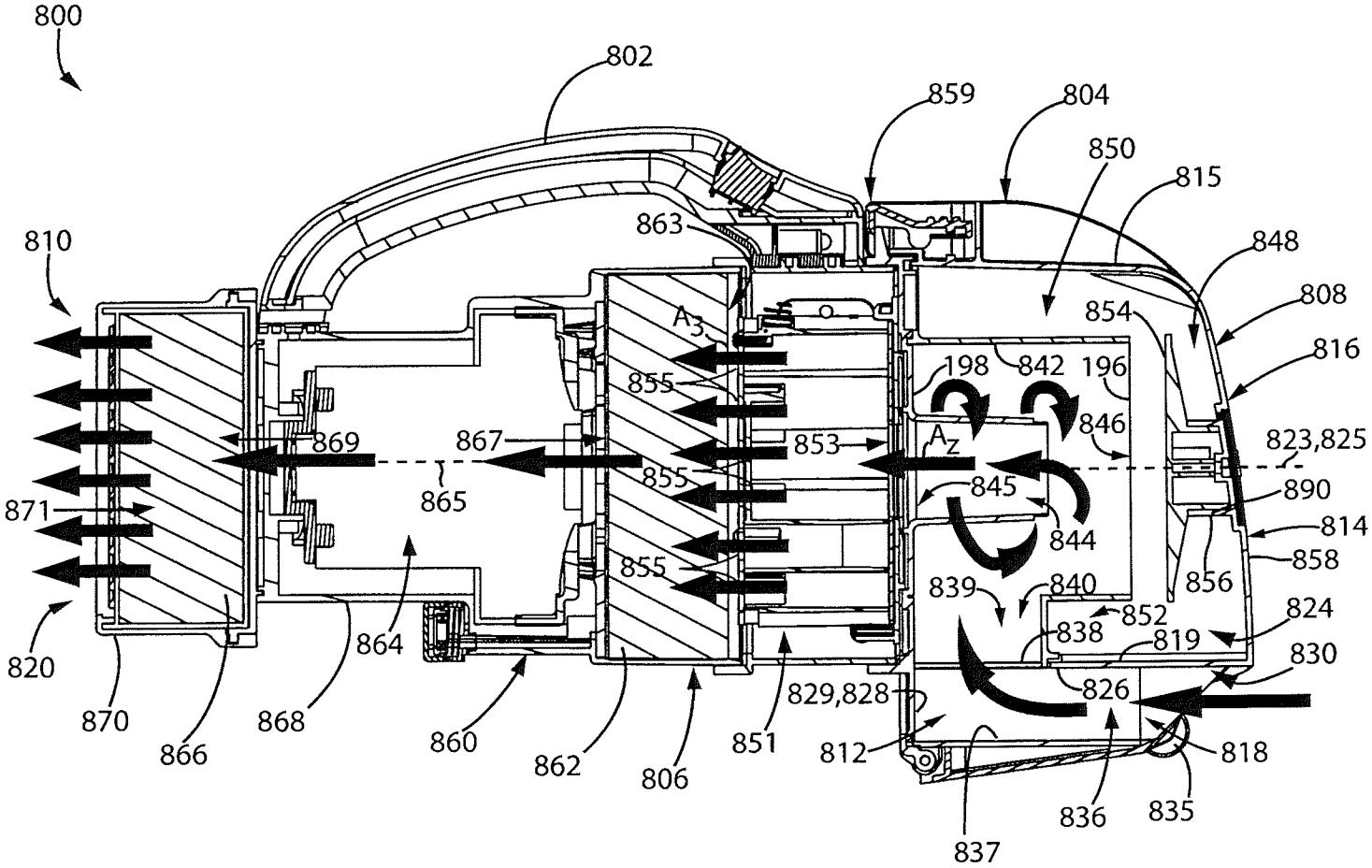
FIG. 8 is a cross section showing an alternate example of a surface cleaning unit.

As shown in FIG. 8, a downstream end of the suction motor 864 may have an area in a plane transverse to the motor axis 865 and a projection of all of the area in the direction of the motor axis 865 may intersect the clean air outlet 820. For example, the clean air outlet 820 may have an area in a direction transverse to a direction of air flow through the clean air outlet 820 that is larger than the cross-sectional area of the downstream end of the suction motor 864 in a plane transverse to the motor axis 865.

The cleaner body 160 preferably further comprises a post-motor filter housing 170. A post motor filter 166 is provided in the post-motor filter housing 170. The post motor filter 166 is provided in the airflow path downstream of, and preferably adjacent, the suction motor 164. The post-motor filter comprises an inlet 169 and an outlet 171. Outlet 171 is at the rear 110 of cleaner 100. In the example shown, the plane of the inlet 169 and, preferably in addition, the plane of the outlet 171 are generally transverse to the motor axis 165. Accordingly, the pre-motor filter air inlet 163, the pre-motor filter air outlet 167, the post motor filter air inlet 169 and optionally the post motor filter air outlet 171 are aligned. Post motor filter 166 serves to remove remaining particulate mater from air exiting the cleaner 100. Post-motor filter 166 may be any type of filter, such as a HEPA filter.

Clean air outlet 120 is provided downstream of post-motor filter 166. Clean air outlet 120 may comprise a plurality of apertures formed in housing 170.

In the example shown, cleaner body 160 is preferably removably mounted to surface cleaning head 116, such as by a bayounet mount, a screw mount or hand manipulateable mechanical fasteners. For example, cleaner body 160 may be entirely removable from surface cleaning head 116, or pivotally mounted to surface cleaning head 116. Accordingly, cleaner body 160 and surface cleaning head 116 may be separated in order to provide access to the interior of cleaner body 160 or surface cleaning head 116. This may allow pre-motor filter 162 to be cleaned, changed, or serviced, or motor 164 to be cleaned, changed or serviced. Alternately, surface cleaning head 116 may be cleaned or serviced. For example, any dirt stuck in outlet passage 144 may be removed. Alternately, a replacement cleaner body 160 or surface cleaning head 116 may be provided, and may be mounted to an existing surface cleaning head 116 or cleaner body 160, respectively.

One or more additional wheels 180 may be mounted to housing 161, preferably at lower portion 106, and may be used in conjunction with wheels 135. Preferably, a single rear wheel 180 is provided. Preferably, rear wheel 180 is located on a centre line of the vacuum cleaner and rearward of the depending wall 128.

Referring now to FIG. 8, in which like numerals refer to like features, with the first digit incremented to 8 to refer to the figure number, an alternate example of a hand vacuum cleaner 800 is shown. In this example, front wall 858 is not pivotally mounted to wall 815. Rather, wall surface cleaning head 816 is pivotally mounted to body 860.

Cleaner 800 further comprises a second optional cyclone unit 851 downstream of the first cyclone unit 814, between first cyclone unit 814 and pre-motor filter 862. In the example shown, the second cyclone unit 851 comprises a plurality of cyclones in parallel. Each of the plurality of cyclones is parallel to the first cyclone axis 823. Second cyclone unit 851 has an air inlet 853 and a plurality of air outlets 855. The direction of flow into the inlet 853 (indicated by arrow A2), and out of the outlets 855 (indicated by arrows A3) is the same as the direction of flow through the outlet 845 of the first cyclone unit 814 (also indicated by arrow A2).

Figure 9:
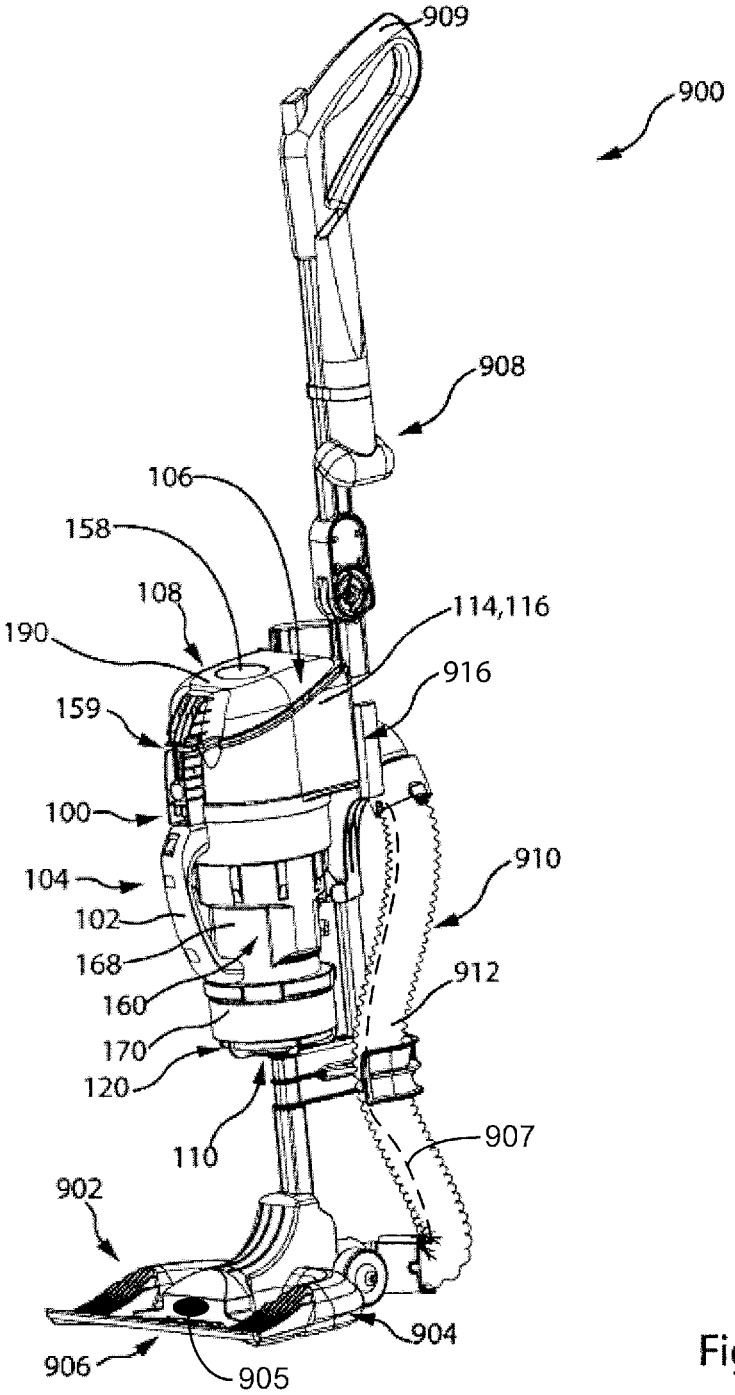
FIG. 9 is a perspective illustration of the surface cleaning unit of FIG. 1 mounted in a surface cleaning apparatus.
Figure 10:
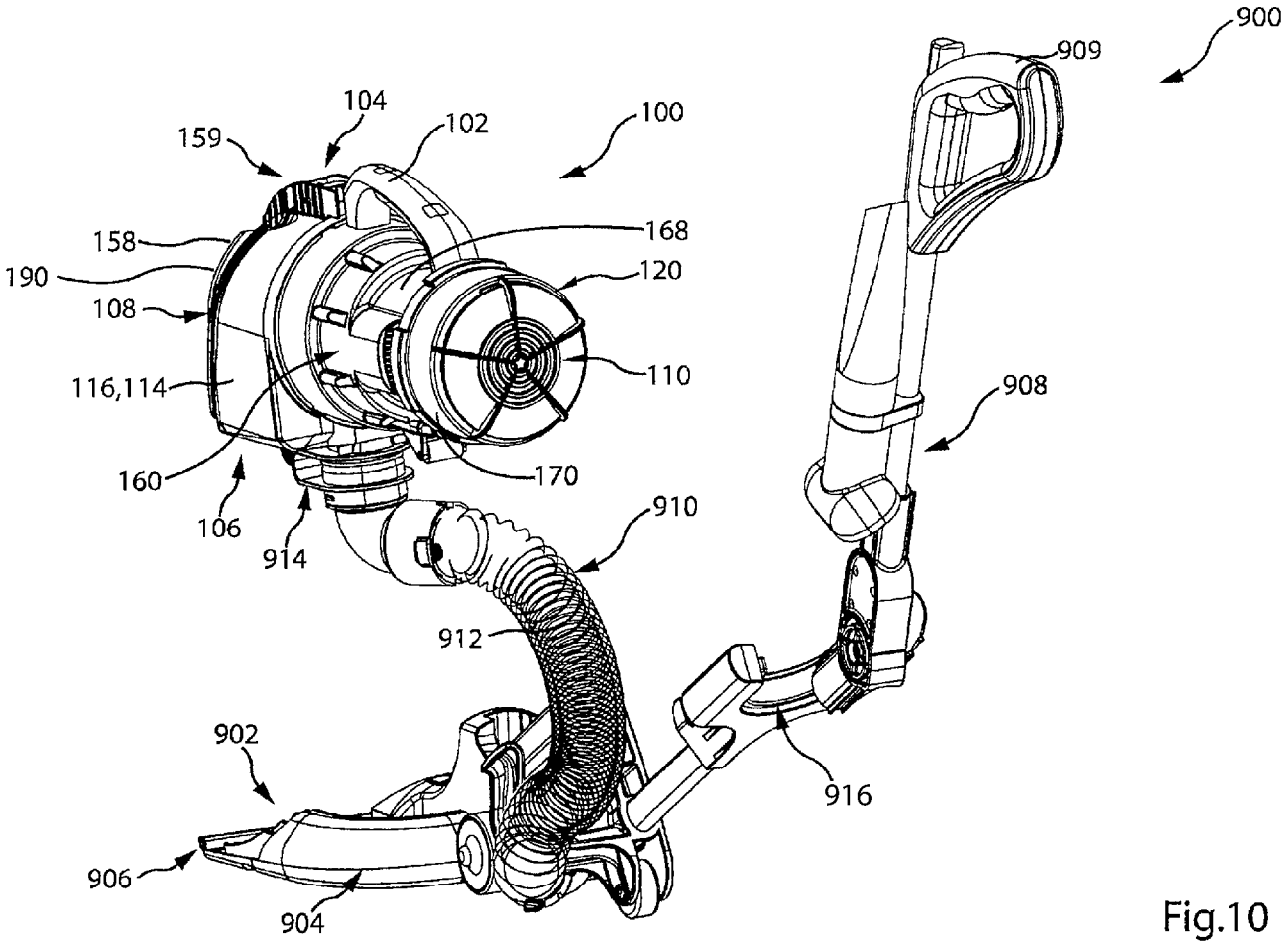
FIG. 10 is a perspective illustration of the surface cleaning unit of FIG. 1 in airflow communication with the surface cleaning apparatus of FIG. 9.

Referring now to FIGS. 9 and 10, in some embodiments, surface cleaning unit 100 is removably mountable in a surface cleaning apparatus. For example, surface cleaning unit 100 may be removably mounted to form a canister type surface cleaning apparatus, or, as shown, an upright surface cleaning apparatus 900. Preferably, as shown, surface cleaning unit 100 is usable as a hand vacuum cleaner, as described hereinabove, as well as being removably mountable in a surface cleaning apparatus. In alternate embodiments, surface cleaning unit 100 may be removably mounted in a surface cleaning apparatus, without being usable as a hand vacuum cleaner. For example surface cleaning unit 100 may not be provided with a surface cleaning nozzle 112, and may serve only as a removable pod of a surface cleaning apparatus.

In the embodiment shown, upright cleaning apparatus 900 comprises a floor cleaning unit 902, which comprises a surface cleaning head 904. The surface cleaning head comprises a dirty air inlet 906. A handle 908 is drivingly connected to the surface cleaning head 904, such that a user may grip the handle 908 and move the surface cleaning head 904 along a surface to be cleaned.

As exemplified, the surface cleaning unit 100 is connectable in airflow communication with the surface cleaning head 904. More particularly, the surface cleaning unit is connectable to the surface cleaning head 904 such that an airflow passage extends from the dirty air inlet 906 of the surface cleaning head to the clean air outlet 120 of the surface cleaning unit 100. For example, as shown, a portion 910 of the airflow passage extends between the surface cleaning head 904 and the surface cleaning unit 100. The portion 910 comprises a flexible conduit 912, which in the embodiment shown is hose. An attachment member 914 is provided, which connects the flexible conduit 912 to the cyclone unit 114 of the surface cleaning unit.

Optionally, the surface cleaning head 904 may include one or more electrically powered components, such as, for example an electrically driven rotating agitator brush and/or a headlight. Providing such an electrically powered component may help improve the performance of the surface cleaning head 904 (such as by agitating the underlying surface and/or illuminating the surface to be cleaned). Referring to FIG. 9, in the illustrated embodiment the surface cleaning head 904 includes a generally forward facing headlight 905. The headlight 905 may include one or more suitable light emitting sources, including, for example, incandescent light blubs, fluorescent light blubs, light emitting diodes (LEDs) or other suitable sources.

Electrical power may be provided to the surface cleaning head 904 from any suitable source, including, for example, by providing an electrical connection between the surface cleaning unit 100 and the surface cleaning head 904. Providing an electrical connection between the surface cleaning unit 100 and the surface cleaning head 904 may allow the electrical power provided to the surface cleaning unit 100, via on board power source, electrical cord connected to a wall socket (or a combination of both), to be provided to the surface cleaning head 904 without requiring a separate electrical cord that is plugged into an external power source, etc. for the surface cleaning head. Optionally, the flexible conduit 912 is an electrified stretch hose that provides an electrical connection between the surface cleaning unit 100 and the surface cleaning head 904. In the illustrated example, the flexible conduit 912 includes at least one conductor (e.g. one or more wires) which is illustrated schematically in FIG. 9 using dashed line 907. Optionally, the conductors may be integrally formed within the walls of the flexible conduit 912, or may be separate conductors that are affixed to the inner and/or outer surfaces of the flexible conduit 912. For example, the wires may be provided in a spiral adjacent the resilient member that provides the biasing to a flexible stretch hose.

As exemplified, the surface cleaning unit 100 is removably mounted to and supported by handle 908, which extends upwardly from the floor cleaning unit 902 and comprises a handgrip 909. Preferably, handle 908 comprises a mount 914. In the embodiment shown, mount 914 comprises a U-shaped recess. The attachment member 914 is lockably receivable in the U-shaped recess, to mount the surface cleaning unit 100 to the handle 908 such that, the cyclone unit 114 and the suction motor 164 are supported by the handle 908.

In the exemplified embodiment, the attachment member 914 mounts the cyclone unit 114 to the handle 908. In alternate embodiments, any other portion of the surface cleaning unit 100, such as the motor housing 168, or the handle 102, may be mounted to the handle 908. Further, the portion may be mounted to the handle indirectly, such as via attachment member 914 as shown, or directly. For example handle 102 may be directly received in a mount provided on handle 908.

As can be seen in FIG. 9, preferably, when the surface cleaning unit 100 is mounted to the floor cleaning unit 902, the first cyclone unit 114 is positioned above the suction motor 164. That is, the suction motor 164 is below the cyclone unit 114. Accordingly, the front end 108 of the surface cleaning unit 100 becomes an upper end of the cyclone unit 114, and the openable door 158 is at the upper end of the cyclone unit 114. When the surface cleaning unit 100 is in this configuration, the linear airflow path between the first cyclone unit 114 and the suction motor 164 is generally vertical and flows generally downwardly.

Preferably, surface cleaning unit 100 is operable both when mounted to the floor cleaning unit 902, and when removed from the floor cleaning unit 902. That is, as shown in FIG. 10, the surface cleaning unit 100 may remain in fluid communication with floor cleaning unit 902, even when attachment member 914 is removed from mount 914. As the flexible conduit 912 may provide both the electrical connection and the air flow connection between the surface cleaning unit 100 and the surface cleaning head 904, in the illustrated configuration, both the air flow connection and the electrical connection between the surface cleaning head 904 and the surface cleaning unit 100 may remain uninterrupted when the surface cleaning unit 100 is removed from the handle 908. Accordingly, a user may hold handle 102 of surface cleaning unit 100 with a first hand, and hold handgrip 909 with a second hand. This may be useful in cleaning hard to reach locations, or small areas.

Figure 11:
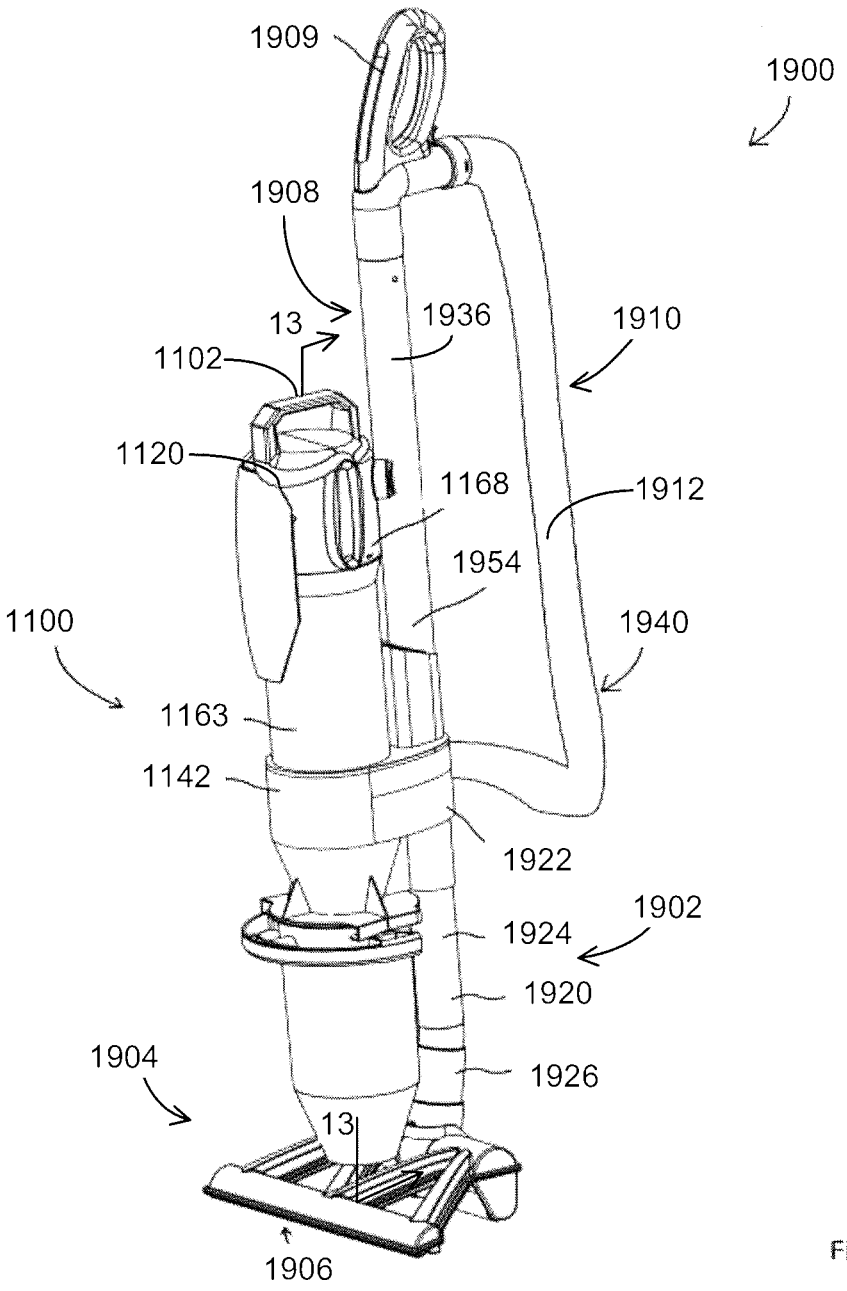
FIG. 11 is a perspective illustration of another example of a surface cleaning apparatus.

Referring to FIG. 11, another embodiment of a surface cleaning unit 1100 is illustrated. The surface cleaning unit 1100 is generally similar to the surface cleaning unit 100, and analogous features are identified using analogous reference characters indexed by 1000. In the illustrated example the surface cleaning unit 1100 is removably mounted to another example of an upright surface cleaning apparatus 1900. The upright surface cleaning apparatus 1900 is generally similar to the upright surface cleaning apparatus 900, and analogous features are identified using analogous reference characters indexed by 1000.

Figure 13:
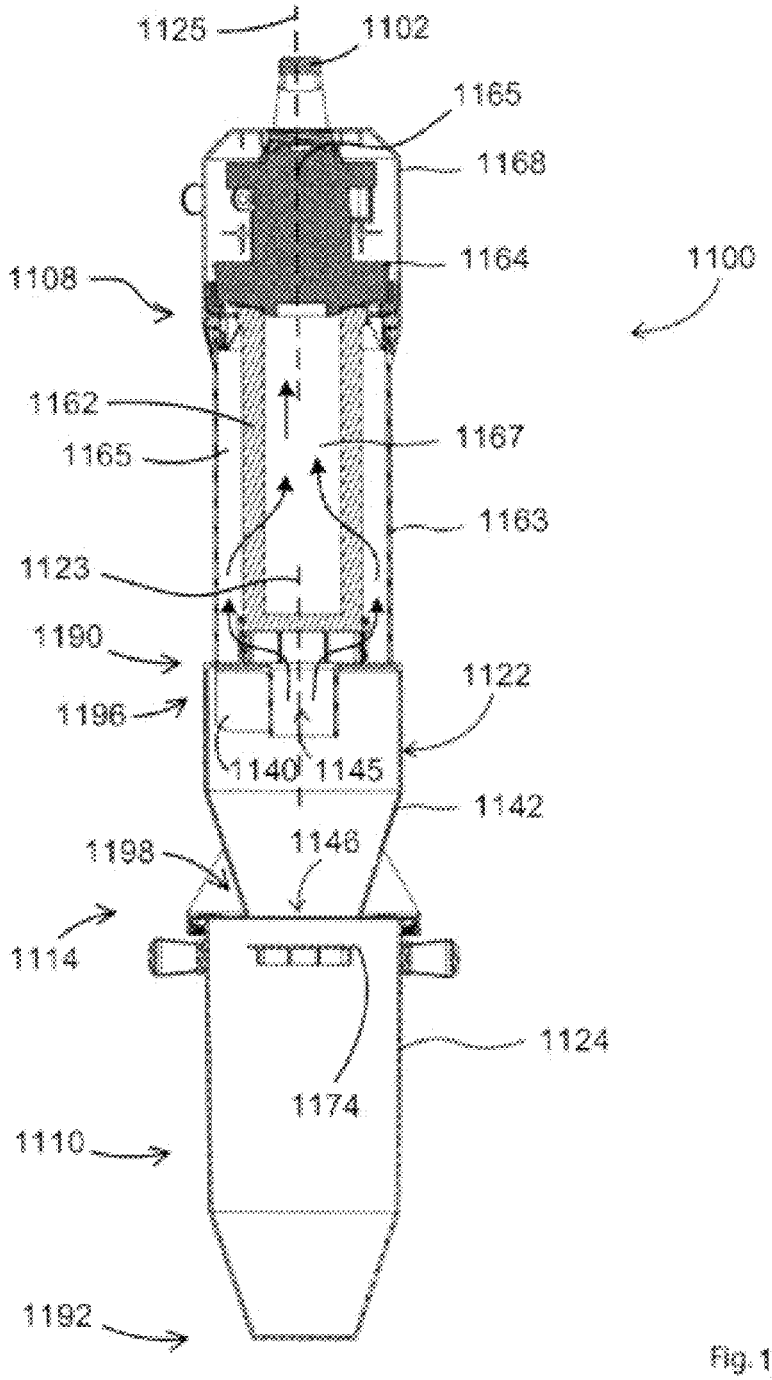
FIG. 13 is another cross-sectional view of a portion of the surface cleaning apparatus of FIG. 11, taken along line 13-13 in FIG. 11.

Referring also to FIG. 13, in the embodiment shown, the surface cleaning unit 1100 is usable as a vacuum cleaner, and more particularly a portable vacuum cleaner. The surface cleaning unit 1100 can be carried and maneuvered by a user by gripping and maneuvering handle 1102 (see also FIG. 15). The surface cleaning unit 1100 includes a first end 1108, and a second end 1110 (see FIG. 13). A longitudinal axis 1125 of the surface cleaning unit 100 extends between the first end 1108 and the second end 1110. In the example shown, handle 1102 is provided at the first end 1108. In alternate examples, handle 1102 may be provided elsewhere on the surface cleaning unit 1100, for example at the second end 1110 or along a sidewall portion, and may be of any design.

In the example shown, the surface cleaning unit 1100 comprises a cyclone unit 1114 that is provided in the airflow passage. Referring to FIG. 13, the cyclone unit 1114 has a first end 1190, and a second end 1192. In the example shown, the cyclone unit 1114 includes one cyclone 1122, and one dirt collection chamber 1124, which are separately formed. The suction motor 1164 is positioned above the cyclone 1122.

In the illustrated example, a single cyclone 1122 is used and the direction of air exiting the outlet of cyclone 1122 is substantially the same as the direction of airflow immediately upstream of the suction motor 1164 (i.e., as it enters the suction motor air inlet). In the illustrated example the air exiting the cyclone air outlet and entering the suction motor inlet travels generally axially, and upwardly as illustrated. The motor has a motor axis 1165, which in the illustrated example is co-axial with the axis 1125.

An optional pre-filter 1162, in a filter housing 1163, is positioned between the cyclone air outlet 1145 and the suction motor 1162. Air exiting the cyclone 1122 via the air outlet 1145 is diverted generally radially outwardly into an annular space 1165 formed between the filter housing 1163 and generally cylindrical filter 1162. Air can then flow generally radially inwardly through the filter 1162 into a generally axially oriented filtered air flow path 1167 of the air flow passage that conveys the air to the inlet of the suction motor 1164. In this configuration the filter 1162 and housing 1163 have a generally axial configuration, (i.e., they have a longitudinal length between the downstream end adjacent the cyclone outlet and an upstream end adjacent the motor air inlet that extends generally parallel to the motor axis 1165 and the cyclone axis 1123) and air flowing from the cyclone air outlet 1145 to the inlet of the suction motor 1165 flows in a generally axial direction through the filtered air flow path 1167.

Alternately, the pre-motor filter may be the same or similar to the pre-motor filter of the embodiment of FIG. 8. For example, the pre-motor filter may be a foam filter having an upstream face transverse to the cyclone and motor axes.

It will be appreciated that cyclone 1122 may be of any configuration and orientation. Preferably, cyclone 1122 comprises a chamber wall 1142. The cyclone chamber is located inside chamber wall 1142. The cyclone 1122 extends along an axis 1123, which, in the example shown, is generally co-axial with the cleaning unit axis 1125 and the motor axis 1165. Axis 1123 preferably extends generally vertically when surface cleaning unit 100 is in an upright storage position (FIGS. 11 and 13). Cyclone 1122 has a first end 1196, and a second end 1198 that is spaced from the first end 1196 in the axial direction.

In the illustrated embodiment, the cyclone air inlet 1140 and the cyclone air outlet 1145 are at the same end (first end 1196) of the cyclone 1122 and the dirt outlet 1146 is at an opposed end (second end 1198). Optionally, the cyclone air outlet 1145 may be covered by a screen or shroud or filter as is known in the art. As exemplified, the cyclone air inlet 1140 is defined by an aperture in the chamber wall 1142. The air travels in a cyclonic path in the cyclone 1122, and dirt in the air is separated from the air.

The dirt that is separated from the air exits the cyclone via dirt outlet 1146, and enters dirt collection chamber 1124. Dirt outlet 1146 is preferably at the second end 1196 of the cyclone 1122, and further, is located generally toward the second 1110 of the cleaning unit 1100. The dirt collection chamber 1124 may be internal or external to the cyclone chamber. Preferably, as exemplified, the dirt collection chamber is external. The dirt collection chamber 1124 may be in communication with the cyclone chamber 1122 by any means known in the art.

As exemplified in FIG. 13, in the illustrated embodiment, a plate 1174 is positioned adjacent dirt outlet 1146. It will be appreciated that plate 1174 may be positioned at any height in dirt chamber 1124. Preferably, plate 1174 is positioned proximate the top of dirt chamber 1124 and proximate dirt outlet 1146 from cyclone 1122. Preferably, the minimum distance between plate 1174 and outlet 1146 is at least as large as the largest dimension of the cyclone inlet 1140. For example, if the cyclone inlet 1140 has a 1 inch height, then the minimum distance between plate 1174 and outlet 1146 is preferably is 1 inch or larger. An advantage of such a design is that any dirt particle that enters the cyclone housing 1142 will be able to pass through the gap into dirt collection chamber 1124. The distance between the top of plate 1174 and the bottom of the cyclone housing 1142 may be 0.01-2.5 inches and is preferably at least the largest diameter of the cyclone inlet 1140.

In some embodiments, the plate 1174 may be removable with dirt chamber 1124 from the surface cleaning unit 1100. An advantage of this design is that plate 1174 defines a partial cover for the dirt collection chamber 1124. Alternately, the plate 1174 may remain in position when dirt chamber 1124 is removed. In such an embodiment, plate 1174 is preferably attached to the bottom of cyclone housing 1142.

Referring to FIG. 11, in the embodiment shown, the upright cleaning apparatus 1900 comprises a floor cleaning unit 1902, which comprises a surface cleaning head 1904. The surface cleaning head comprises a dirty air inlet 1906. A handle 1908 is drivingly connected to the surface cleaning head 1904, such that a user may grip the handle 1908 and move the surface cleaning head 1904 along a surface to be cleaned.

Figure 15:
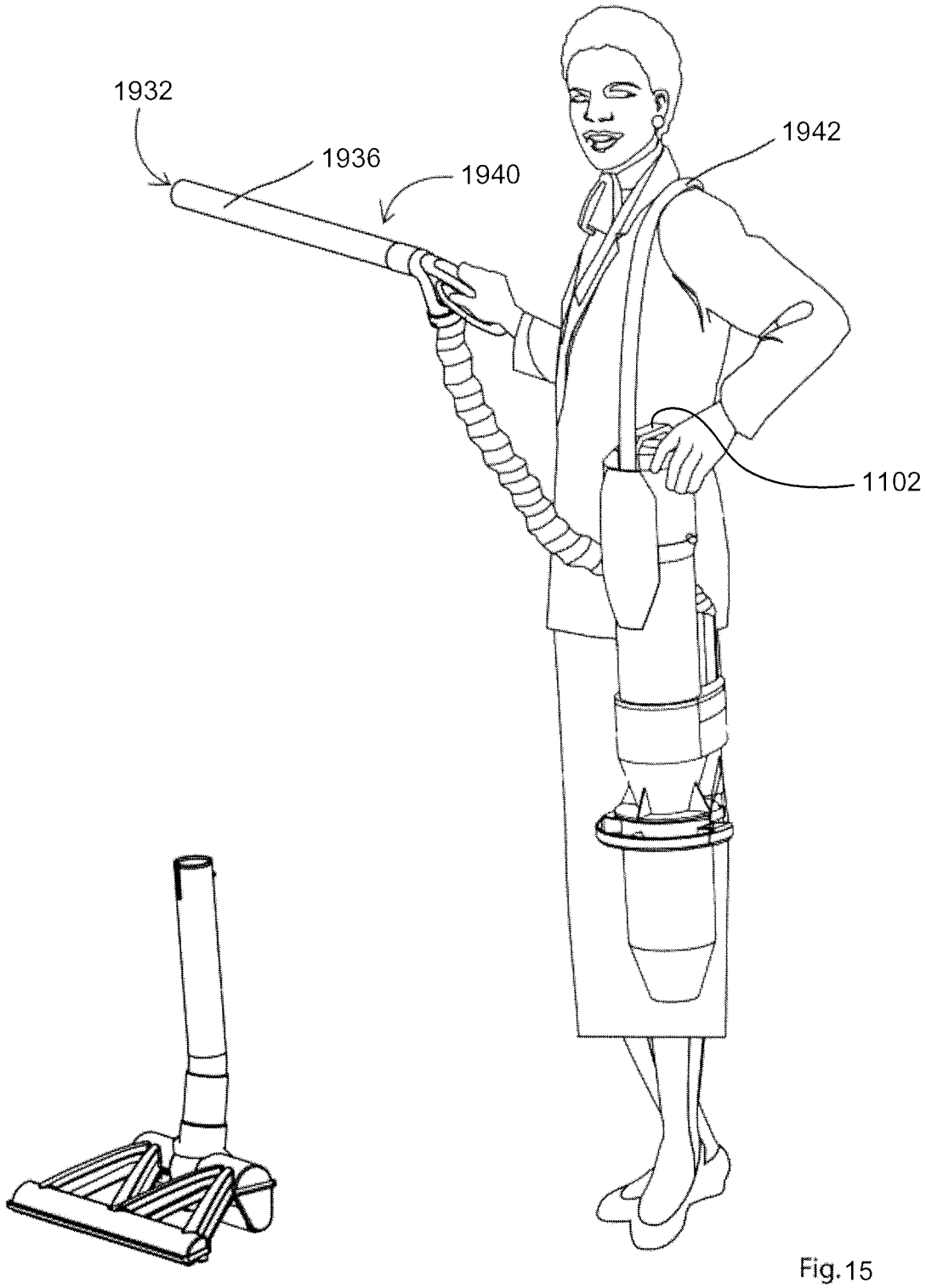
FIG. 15 is a perspective view of the surface cleaning apparatus of FIG. 11 in another floor cleaning configuration.

Referring also to FIG. 15, in the illustrated example, the surface cleaning unit 1100 is removably mounted to and supported by handle 1908, which extends upwardly from the floor cleaning unit 1902 and includes a handgrip 1909

As can be seen in FIG. 11, preferably, when the surface cleaning unit 1100 is mounted to the support member 1920 and is in the storage position, the cyclone unit 1114 is positioned below the suction motor 1164. That is, the suction motor 1164 is above the cyclone 1122 and the dirt collection chamber 1124. When the surface cleaning unit 1100 is in this configuration, the substantially linear airflow path between the first cyclone unit 1114 and the suction motor 1164 is generally vertical and flows generally upwardly.

In the illustrated example, the surface cleaning unit 1100 is operable both when mounted to the floor cleaning unit 1902, and when removed from the floor cleaning unit 1902. Accordingly, a user may hold handle 1102 of surface cleaning unit 1100 with a first hand, and hold handgrip 1909 with a second hand. This may be useful in cleaning hard to reach locations, or small areas.

As exemplified, the surface cleaning unit 1100 is connectable in airflow communication with the surface cleaning head 1904. More particularly, the surface cleaning unit 1100 is connectable to the surface cleaning head 1904 such that an airflow passage extends from the dirty air inlet 1906 of the surface cleaning head to the clean air outlet 1120 of the surface cleaning unit 1100. For example, as shown, a portion 1910 of the airflow passage extends between the surface cleaning head 1904 and the surface cleaning unit 1100. The portion 1910 comprises a flexible conduit 1912, which in the embodiment shown is hose. An attachment member 1914 is provided, which connects the flexible conduit 1912 to the cyclone unit 1114 of the surface cleaning unit.

In the illustrated embodiment, a support member or spine 1920 is mounted to the surface cleaning head 1904, and a mounting member 1922 is mounted to the support member 1920. At least two operating components of the surface cleaning unit 1100 are mounted directly or indirectly to the mounting member 1922. When the illustrated apparatus is in use, fluid enters surface cleaning head 1904 via dirty fluid inlet 1906 and is directed upwards into the at least one cleaning stage via an upflow duct 1924. In the illustrated embodiment, the support member 1920 comprises upflow duct 1924. That is, support member 1920 provides at least a portion of the air flow passage between surface cleaning head 1904 and surface cleaning unit 1100. In other embodiments, upflow duct 1924 may be a separate member. For example, upflow duct 1924 may be a conduit that is affixed to support member 1920. In the embodiments shown, support member 1920 is pivotally mounted to surface cleaning head 1904 via a pivoting connector 1926.

Figure 14:
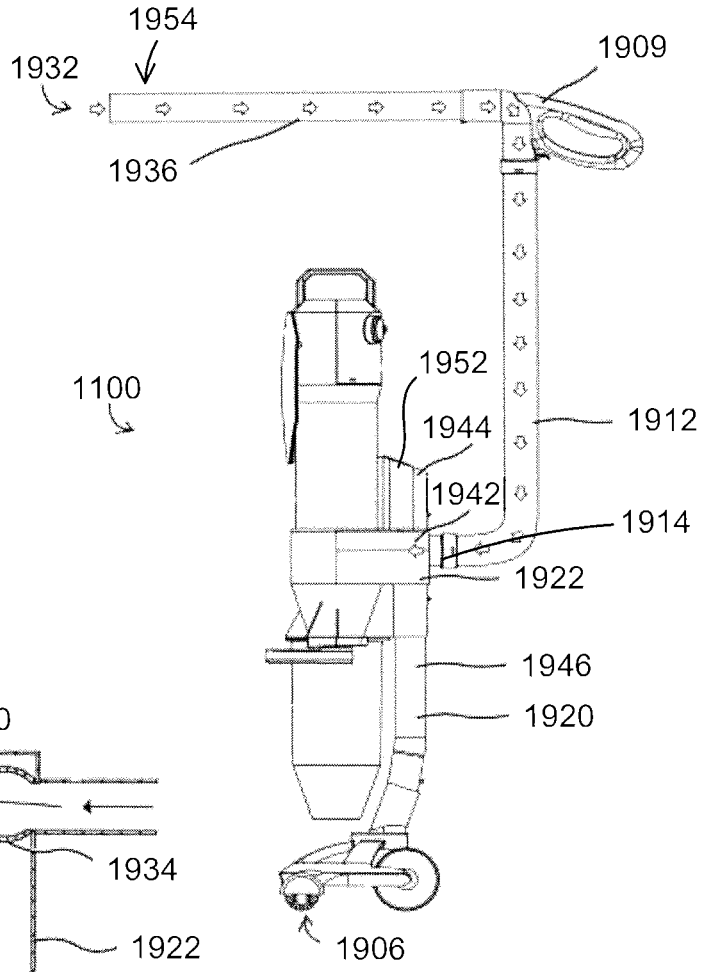
FIG. 14 is a side view of the surface cleaning apparatus of FIG. 11 in an above floor cleaning configuration.

In the embodiments shown, support member 1920 extends upwardly towards mounting member 1922. Mounting member 1922 serves as a support for the surface cleaning unit 1100. In the preferred embodiment, cleaning stage 1100 is directly or indirectly mounted to mounting member 1922, as will be described further hereinbelow. In some embodiments, mounting member 1922 may be integrally formed with support member 1920. In other embodiments, as shown in FIGS. 13 and 14, mounting member 1922 may be integrally formed as a component of the surface cleaning unit 1100. In other embodiments, mounting member 1922 may be a separate member. As exemplified, mounting member 1922 may form a portion of the air flow path (see for example FIG. 12) or it may not include a fluid flow path therethrough.

Figure 12:
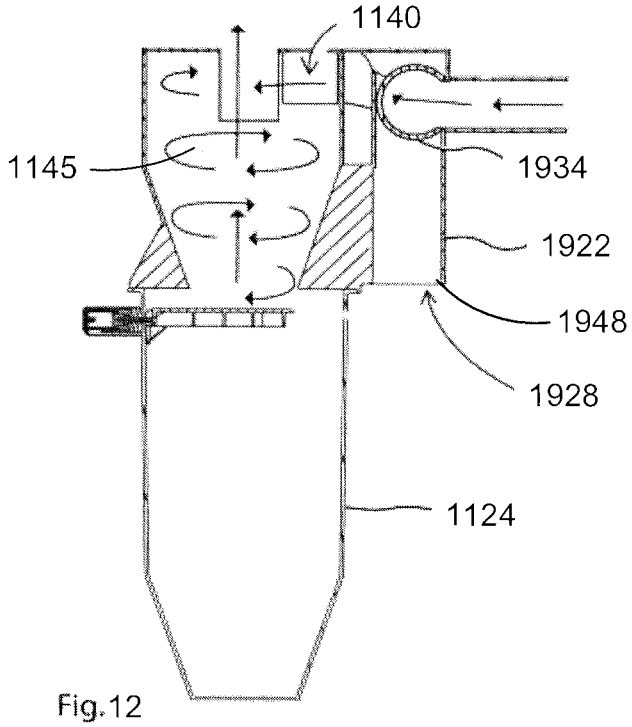
FIG. 12 is a cross-sectional view of a portion of the surface cleaning apparatus of FIG. 11.

In embodiments wherein support 1920 comprises upflow duct 1924, mounting member 1922 may further serve to connect support 24 in fluid communication with cyclone unit 1114. That is, mounting member 1922 may comprise an airflow passage 1928 (FIG. 12). In alternate embodiments (not shown), a mounting member may not be provided, and support 1922 may be mounted directly to the cyclone uint 1114. In further alternate embodiments, wherein upflow duct 1924 is a separate member, a mounting member may not be provided, and upflow duct 1924 and support 1920 may be mounted directly directly to cyclonic unit 1114. In the embodiments shown, air passes from the cleaning head 1904, into mounting member 1922, and from mounting member 1922 into cyclonic unit 1114.

In accordance with another aspect of this invention, which may be used by itself or with any other aspect, the surface cleaning apparatus 1900 comprises the first dirty air inlet 1906 and a second or auxiliary dirty air inlet 1932 (FIG. 15), which are selectively connectable in fluid flow communication with surface cleaning unit 1100. Preferably, surface cleaning unit 1100 is operable in a floor cleaning configuration (in which the dirty air inlet 1906 is in use) and one or more above floor cleaning configurations (in which the auxiliary dirty air inlet is in use). More preferably, the surface cleaning unit 1100 is operable in at least two above floor cleaning configurations.

Surface cleaning apparatus 1900 may be converted from a floor cleaning mode (FIG. 11) to an above floor cleaning mode (FIGS. 14 and 15) by rotating an airflow valve 1934 provided in mounting member 1922. In the floor cleaning mode, valve 1934 connects upflow duct 1920 to cyclone inlet 1140 such that air travels from first dirty fluid inlet 1906 in surface cleaning head 1904 to cyclone inlet 1140. When valve 1934 is rotated to the other position, and elongate wand extension 1936 is removed from mounting member 1922, air travels from second dirty air inlet 1932 through wand 1936, to flexible hose 1912, and past valve 1934 to cyclone inlet 1140. Accordingly, in this embodiment, the first 1906 and second 1932 dirty fluid inlets are respectively in flow communication with first 1938 and second 1940 airflow passages, which merge at a position proximate the inlet of the cyclone 1122. One advantage of this design is that a simplified structure for converting a surface cleaning apparatus 1900 to an above cleaning mode is provided. In addition, as valve 1934 is provided in mounting member 1922, and therefore a few feet above the floor, then a user need not bend down to rotate valve 1934 between the floor cleaning position and the above floor cleaning position. In other embodiments, valve 1934 may be affixed to the handle 1909 or support member 1920.

In the embodiment shown, mounting member 1922 comprises a body 1942 having an upper portion 1944 and a lower portion 1946. Lower portion 1946 defines an opening 1948 (FIG. 12) for receiving an upper end of support member 1920. Upper end of support member 1920 may be securely mounted in opening 1948 by any means, such as by an adhesive, a friction fit, a set screw or the like. In embodiments wherein support member 1920 comprises upflow duct 1924, opening 1948 may be in fluid communication with a cyclone chamber inlet 1140. In the embodiment shown, the upper portion 1944 of mounting member 1922 comprises a second opening 1952 to receive a lower end 1954 (FIG. 14) of the wand 1936, which supports handle 1909. Lower end 1954 may be secured in second opening 1952 by any means known in the art.

In accordance with another aspect of this invention, which may be used by itself or with any other aspect or aspects, surface cleaning apparatus 1900 is convertible to a portable surface cleaning apparatus. That is the surface cleaning unit 1100 is convertible to a portable cleaning and suction unit. Referring to FIG. 15, surface cleaning unit 1100 can be provided with a shoulder strap 1942. In order to convert the surface cleaning apparatus 1900 to a portable surface cleaning apparatus, the user may unwind shoulder strap 1942 and extend it across their shoulder. The surface cleaning unit 1100, including mounting member 1922, may be removed from support member 1920 by, for example, actuating a release catch and lifting the surface cleaning unit 1100 off of support member 1920, for example using handle 1102.

One advantage of the embodiments described above is that the volume of the cleaning apparatus may be reduced. In particular, in the embodiments shown, the outer surfaces of one or more of the cyclone chamber wall 1142, motor housing 1168, filter housing 1163, and dirt chamber 1124 may be visible when surface cleaning apparatus is in use (except for the portions facing support member 1920). Accordingly, the overall volume of the vacuum cleaner is reduced. In addition, the weight of the vacuum cleaner is also substantially reduced. In particular, the amount of plastic that is typically used to construct an upper casing of a cyclonic vacuum cleaner that receives a removable cyclone chamber or dirt chamber substantially increases the weight of the vacuum cleaner. In the embodiments shown, surface cleaning unit 1100 may weigh 10 lbs. or less (without the cord) and, preferably less than 8 lbs.

A further advantage of the embodiments shown is that, if the elements of cleaning unit 1100 are removably mounted to each other and to mounting member 1922, cleaning unit 1100 may be easily disassembled for cleaning. In addition, if a component needs to be replaced, the user may merely acquire the required component (e.g. by purchasing it at a store or on line) and replace the faulty component. For example, if motor 1164 fails, pursuant to a warranty plan, the manufacturer may merely ship the required motor housing 1168 and motor 1164 to the customer who may remove (e.g., unscrew) the motor housing 1168 having the faulty suction motor 1164 and replace it with the new replacement part.

A further advantage of this design is that filter chamber 1163 may be accessed for removal (for cleaning or replacement) by disassembling a portion of the cleaning unit 1100. For example, filter chamber 1163 may be accessed by removing motor housing 1168 from the cleaning unit 1100. Accordingly, a door or the like is not required in filter chamber 1163, thereby simplifying the construction of filter chamber 1163.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto.

The invention claimed is:

1. A surface cleaning apparatus comprising:

an air flow passage extending from a dirty air inlet to a clean air outlet;

a surface cleaning head having the dirty air inlet, the surface cleaning head having a pivoting connector;

a support pivotally mounted to the surface cleaning head by the pivoting connector;

a surface cleaning unit vertically removably mounted to an upper end of the support, the surface cleaning unit comprising:

(i) a cyclone unit positioned in the air flow passage, the cyclone unit comprising a cyclone chamber having a cyclone air inlet, a cyclone air outlet, a dirt outlet and a dirt collection chamber external to the cyclone chamber;

(ii) a pre-motor filter positioned in the air flow passage downstream from the cyclone air outlet;

(iii) a suction motor positioned in the air flow passage downstream from the pre-motor filter; and, (iv) a flexible hose wherein, when the surface cleaning unit is mounted to the support and the support extends vertically, the cyclone unit is mounted to an upper end of a suction motor housing and the surface cleaning unit is in a storage orientation and wherein the cyclone unit is removably mounted to an upper end of the suction motor housing, and wherein, when the surface cleaning unit is in the storage orientation, the cyclone unit has an openable upper end and, when the upper end of the cyclone unit is opened, the cyclone chamber and the dirt collection chamber are concurrently opened, and wherein, when the surface cleaning unit is in the storage orientation mounted, the cyclone air inlet and the cyclone air outlet are provided at a lower end of the cyclone chamber and a dirt outlet is provided at an upper end of the cyclone chamber.

2. The surface cleaning apparatus of claim 1 wherein, in one portable mode, the surface cleaning unit remains in air flow communication with surface cleaning head as the surface cleaning unit is removed from the support.

3. The surface cleaning apparatus of claim 1 wherein, when the surface cleaning unit is mounted to the support and the support extends vertically, the surface cleaning unit overlies the surface cleaning head.

4. The surface cleaning apparatus of claim 3 wherein the dirty air inlet is provided at a front end of the surface cleaning head and, when the surface cleaning unit is mounted to the support and the support extends vertically, a rear side of the portable cleaning unit is mounted to the support and the portable cleaning unit is positioned forward of the support.

5. The surface cleaning apparatus of claim 1 wherein the dirt collection chamber comprises a portion that is positioned radially outwardly of the cyclone chamber.

* * * * *